United States Patent [19]

Ishikawa et al.

[11] Patent Number: 4,738,284

[45] Date of Patent: Apr. 19, 1988

[54] METHOD AND AN APPARATUS FOR DETECTING THE WEFT YARN IN A JET LOOM

[75] Inventors: Mamoru Ishikawa; Yukihiro Tsuji, both of Kariya, Japan

[73] Assignee: Kabushiki Kaisha Toyoda Jidoshokki Seisakusho, Kariya, Japan

[21] Appl. No.: 60,992

[22] Filed: Jun. 12, 1987

Related U.S. Application Data

[63] Continuation of Ser. No. 846,245, Mar. 31, 1986, abandoned.

[30] Foreign Application Priority Data

| | | | |
|---|---|---|---|
| Apr. 5, 1985 | [JP] | Japan | 60-73005 |
| Apr. 13, 1985 | [JP] | Japan | 60-78678 |
| Apr. 13, 1985 | [JP] | Japan | 60-55278 |
| Apr. 16, 1985 | [JP] | Japan | 60-80460 |
| Apr. 19, 1985 | [JP] | Japan | 60-85028 |
| Apr. 25, 1985 | [JP] | Japan | 60-89281 |
| Apr. 25, 1985 | [JP] | Japan | 60-89282 |

[51] Int. Cl.[4] ..... D03D 51/34

[52] U.S. Cl. ..... 139/370.2; 250/561

[58] Field of Search ..... 139/435, 370.1, 370.2; 250/227, 561, 571

[56] References Cited

U.S. PATENT DOCUMENTS

| | | | |
|---|---|---|---|
| 4,471,816 | 9/1984 | Wada | 139/370.2 |
| 4,565,224 | 1/1986 | Keller | 139/370.2 |

FOREIGN PATENT DOCUMENTS

| | | | |
|---|---|---|---|
| 137380 | 4/1985 | European Pat. Off. | 139/370.2 |
| 163448 | 9/1984 | Japan | 139/370.2 |
| 199844 | 11/1984 | Japan | 139/370.2 |

*Primary Examiner*—Henry S. Jaudon

*Attorney, Agent, or Firm*—Brooks Haidt Haffner & Delahunty

[57] ABSTRACT

A light reflection type weft detection apparatus for use in a jet loom is disclosed, in which the weft yarn is caused to travel by a jet fluid within a weft guide passage provided along a reed mounted on a slay, and which detection apparatus includes a light emitting section having an optical axis extending in a direction into the weft yarn guide passage, a light receiving section adapted for receiving the light reflected from the weft yarn in said guide passage, and a device for supporting at its end the light emitting and light receiving sections. The supporting device is mounted on the slay at a position in which it is capable of spreading the warp yarn for intruding into the warp shed. As the reed is receded after beating, the supporting device fitted with the light emitting and receiving sections spreads the warp yarns and intrudes into the warp shed being formed by the warp yarns. The weft yarn is detected as the end of the weft yarn travelling through the weft yarn guide passage traverses the optical axes of the light emitting and receiving sections. In case a failure in weft filling has occurred, that is, when the end of the weft yarn does not traverse the optical axes, the loom operation is halted on the basis of weft insertion failure signals from the light emitting and receiving sections.

13 Claims, 19 Drawing Sheets

METHOD AND AN APPARATUS FOR DETECTING THE WEFT YARN IN A JET LOOM

This application is a continuation of application Ser. No. 846,245, filed Mar. 31, 1986.

BACKGROUND OF THE INVENTION

1. Field of the Invention

This invention relates to a loom, such as an air jet loom. More particularly, it relates to a method and an apparatus for detecting the weft yarn inserted by a jet fluid through a weft yarn guide passage which is provided along the reed.

2. Description of the Prior Art

In a jet loom, wherein the weft yarns are inserted by a jet fluid into the warp shed, the insertion condition of the weft yarns markedly influences the quality of the woven fabric. In the conventional practice shown in FIG. 1, a weft yarn detection unit 2 is provided outside of the trimmed or waste selvage W1 or between the selvage W1 and the woven cloth W in order to determine whether the end of the weft yarn Y impelled from the weft inserting main nozzle has reached the predetermined detection area. This prior-art device is shown for example in the Japanese laid-open patent publication No. 57-5947. In this prior-art device shown for example in FIG. 2 herein, a weft sensor 2 is attached to the front side of the slay 6 and includes at its end a light emitting element 3 and a light receiving element 4 juxtaposed in the direction of the weft guide passage S, and a bar lens 5 ahead of the elements 3, 4. The light projected from the element 3 is condensed by the bar lens 5 and reflected by the weft yarn Y, the reflected light then being condensed by the bar lens 5 and received by the light receiving element 4 for detecting the weft yarn. Thus, the prior-art device aims at improving the weft yarn detection accuracy by increasing the changes in the light volume.

However, when the weft yarn sensor 2 thus aimed at improving the weft yarn detection accuracy is placed outside of the cloth W or the waste selvage W1, as shown in FIG. 1, excess weft yarn must be inserted for assuring a positive weft yarn detection, thus causing wastage of weft yarns to run, counter to the present-day trends towards material saving. In addition, what is called "end failure" that is not abnormal, i.e. the case in which the end of the weft yarn Y does not reach the location of the weft sensor 2 but regular weaving is still achieved, is also regarded by the detector as a failure in weft insertion, so that loom operation is automatically halted. Such needless interruption of the loom operation is not desirable since the operational efficiency of the loom is thereby lowered, while the rate of occurrence of the weaving bar at the time of the halting and starting of the loom is increased, thus adversely affecting the quality of the woven cloth.

When the weft yarn sensor 2 is arranged outside of the woven cloth W, weft yarn detection at an earlier time is not feasible. Thus, the timing of the detection of the failure in weft filling must correspond with the times when weft yarn end reaches the sensor. For example, even in instances wherein the weft yarn end reaches only the half width of the cloth, detection of a failure in weft insertion will be made by the sensor at the time when the weft yarn end is assumed to reach the location of the weft yarn sensor, thus causing delay in sensing the weft yarn insertion error with consequent difficulties in the subsequent control of the loom operation.

For assuring early detection of the weft insertion error, it would be appropriate to position the weft sensor within the extent of the cloth width. However, this has not been feasible with the aforementioned prior-art device since no means are provided to tackle or spread the warp yarns so as to allow insertion of the sensor into the warp shed.

Japanese laid-open patent publication No. 54-240501 shows a weft yarn detection apparatus in which the light emitting section is provided on the top of the reed within the upper region of the warp yarns, and the light receiving section is provided in the lower region of the warp yarns so that the projected light may be received by the light receiving element in the lower region of the warp yarns to permit weft yarn detection within the extent of the cloth width. However, a positive yarn detection is not possible with the prior-art system designed to sense one weft yarn by using projected light adapted to traverse the densely arranged warp yarns, and the accuracy in weft yarn detection achievable with the prior-art system is usually low.

SUMMARY OF THE INVENTION

According to one aspect of the present invention, there is provided an apparatus for detecting the weft yarn, according to which means for engaging the warp yarns and intruding into the warp shed are provided so that the ends thereof confront the weft yarn guide passage provided along the reed, said ends carrying the light emitting and light receiving sections having their optical axes oriented towards the weft guide passage or channel, with the projected light from the light emitting section being reflected by the weft yarn and the reflected light being received by the light receiving section for detecting the weft yarn disposed within the guide passage or channel.

When the reed is receded after beating, the supporting means provided with the light emitting and receiving elements engage the warp yarns that are in the course of forming the shed, said means then intruding into the shed. The weft yarn is detected when the end of the yarn travelling through the guide passage traverses the optical axes of the light emitting and receiving sections. In case of a failure in weft insertion, that is, when the weft yarn end does not traverse the optical axes, the loom operation is discontinued on the basis of the weft insertion error detection signal supplied from the light emitting and receiving sections. Hence, the loom operation can be controlled on the basis of early detection of the weft insertion error. The weft yarn can be detected within the warp shed so that there is no risk of weft yarn wastage inherent in the prior-art system.

According to a preferred embodiment of the present invention, the supporting means comprises a pair of supporting pieces spaced apart from each other, one of the supporting pieces carrying a light emitting section comprising a photoelectric element and the other carrying a light receiving section similarly comprising a photoelectric element. In this case, the thickness of each supporting piece can be reduced to as small a value as possible to permit smooth intrusion of the supporting pieces into the warp shed. For this reason, the photoelectric elements or photo-sensors carried by these pieces are necessarily reduced in size so that their properties are unavoidably lowered. Therefore, when the weft yarn should be detected within the warp shed, it is difficult to rely on increases in the light volume to elevate the accuracy in the yarn detection as in case of the aformentioned prior-art detection system.

According to another aspect of the present invention, there is provided a method for detecting the weft yarn in a weft yarn detection apparatus wherein one of a pair of supporting pieces adapted to engage the weft yarns so as to be intruded into the warp shed is provided with a terminal light emitting element, while the other supporting piece is provided with a terminal light receiving element, said supporting pieces being spaced apart in juxtaposition along the weft yarn guide passage formed on the front side of the reed to permit the warp yarn to be introduced into the space between the adjoining pieces, said method comprising the steps of counting the number of pulse signals within the preset range inclusive of the warp detection pulse signal from the light receiving element, assuming the occurrence of weft yarn detection when the count number reaches the preset value, and stopping the loom when the count number does not reach said preset value.

The pulse signals are composed not only of plural detection pulse signals due to vibrations of the weft yarns introduced into the weft yarn guide channel but of flying cotton detection signals or noise signals. The aforementioned preset value is determined on the basis of the preestimated number of these detection signals within the aforementioned preset range. The time interval during which the warp yarn traverses the space between the photo-sensors is included in the preset range, while the number of warp detection pulse signals "1" that are produced when the warp yarn traverses the space between the photo-sensors is included in the number of detection pulse signals within the preset range. Thus, the number of pulse signals in the preset range is a sufficient number higher than the preset value in case of regular weft insertion to provide for positive detection of the weft yarn.

These and other advantages and attainment of the present invention will become apparent to those skilled in the art upon a reading of the following description when taken in conjunction with the drawings wherein there are shown and described illustrative embodiments of the invention.

BRIEF DESCRIPTION OF THE DRAWINGS

In the course of the following detailed description, reference will be made to the attached drawings in which:

FIGS. 27(*a*) to (*g*) are diagrams showing the various processing stages of the weft yarn detection signals in the prior-art weft yarn detection system.

DESCRIPTION OF THE PREFERRED EMBODIMENTS

Figure 3:
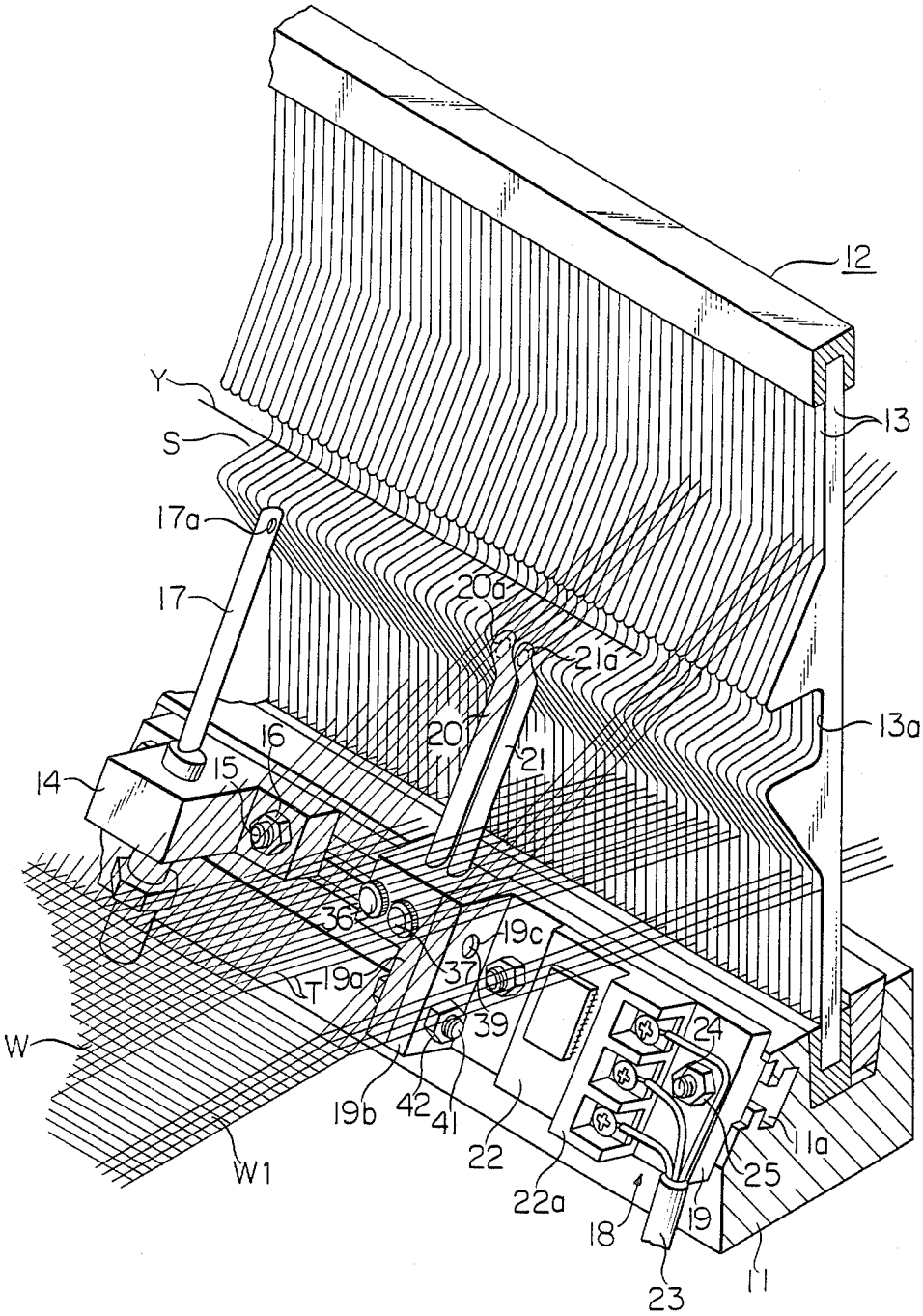
FIG. 3 is a perspective view showing essential parts of the loom into which several embodiments of the weft yarn detection apparatus of the present invention are incorporated.
Figure 4:
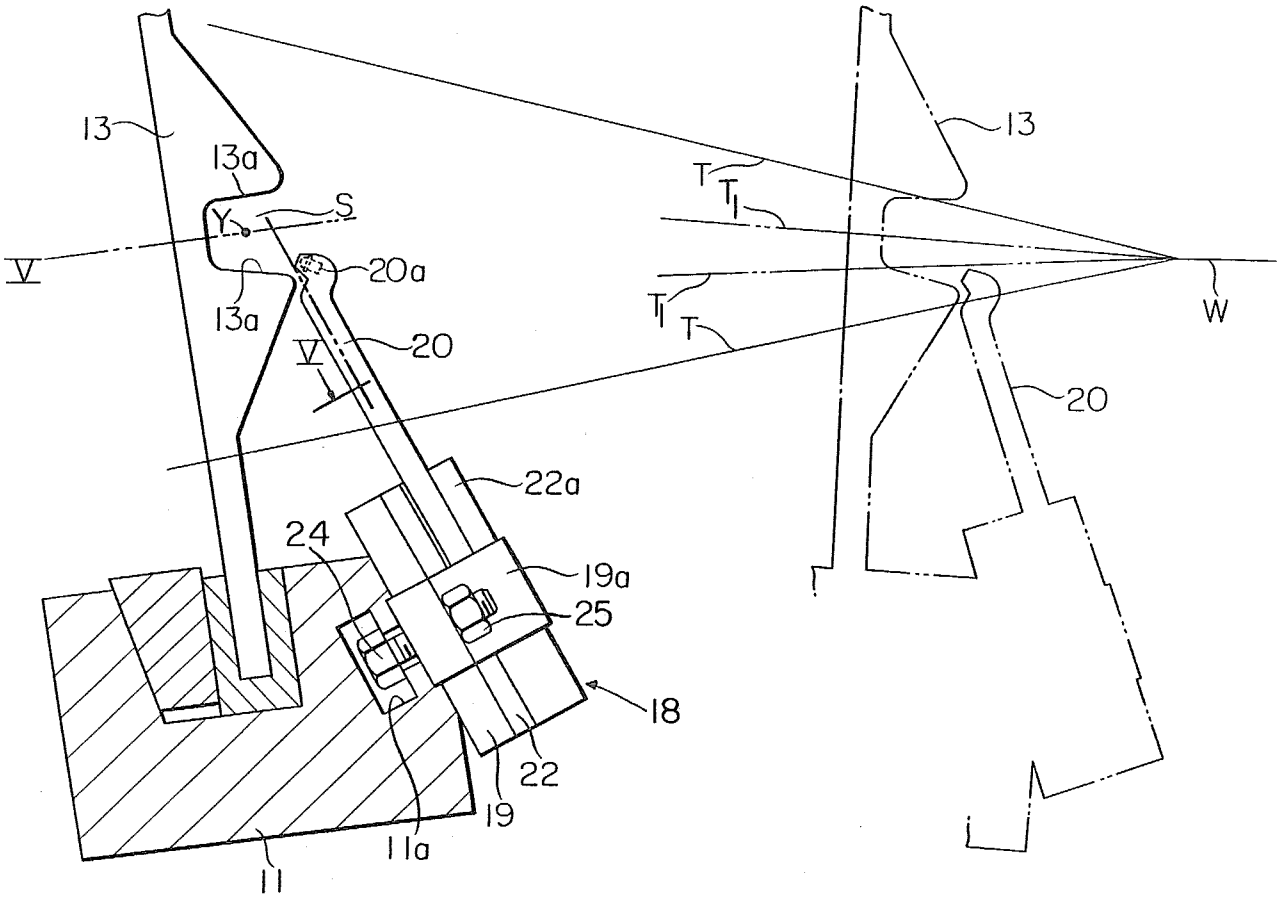
FIG. 4 is a cross-sectional side view of the loom when seen in the weft inserting direction and illustrating the method of the present invention.
Figure 5:
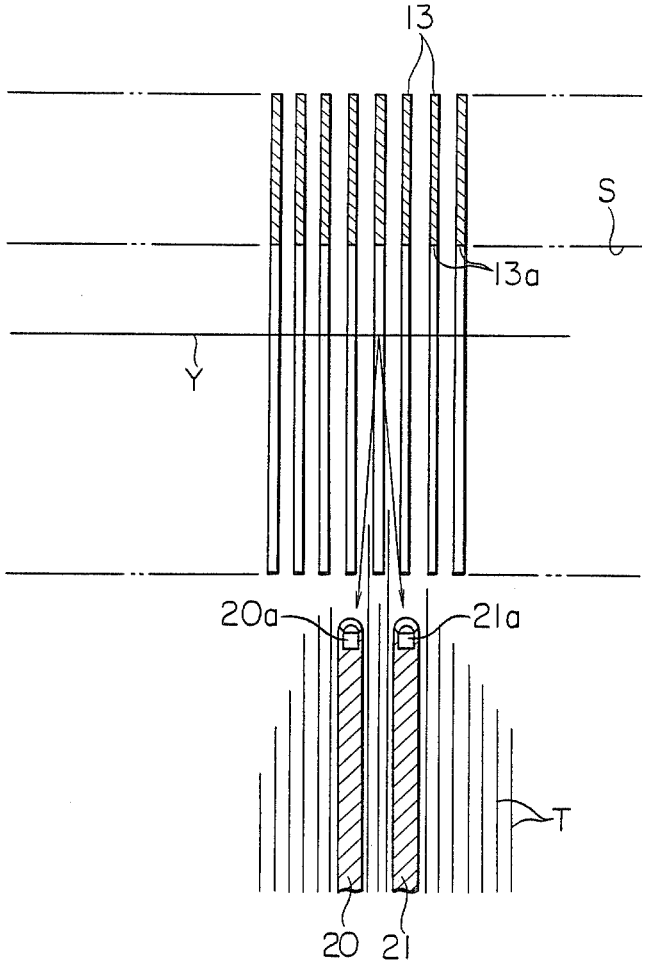
FIG. 5 is an enlarged sectional view along line V—V of FIG. 4.

Referring now to the drawings, wherein like reference characters designate corresponding parts throughout the various views, and more particularly to FIGS. 3 to 5, there is mounted upright on a slay 11 a reed 12 having the function of guiding the weft yarn Y impelled from a weft inserting main nozzle, not shown. On the front sides of a large number of reed teeth 13 of the reed 12 are formed aligned guide grooves 13*a* providing a guide channel or passage S for the weft yarns Y.

On the front side of the slay 11 is formed a mounting groove 11*a* longitudinally thereof and, in association with the reed 12 a number of supporting blocks 14, only one being shown in FIG. 3, is secured by a bolt 15 and a nut 16 introduced into the groove 11*a* so that the block will be slid and clamped in the desired position along the groove 11*a*. In each block 14 is securely inserted an auxiliary nozzle 17 in an upright position so that an injection port 17*a* at the end of the nozzle 17 is in the vicinity of the guide channel S in such a condition that the auxiliary jet fluid from the port 17*a* will assist in the travel of the weft yarn Y impelled into the channel S.

A weft yarn sensor 18 is clamped by a bolt 24 and a nut 25 on the front side of the slay 11 at a position within the region of the warp yarns T of the woven cloth W. Alternatively, it might be positioned near the cloth end (innermost warp yarn T) remote from the weft insertion nozzle (not shown). The sensor 18 can be adjusted in its slide position along the groove 11*a*. The sensor 18 is made up of a supporting plate 19, and a pair of supporting pieces 20, 21 attached to an attachment unit 19*a*, protuberantly provided to one side of the supporting plate 19, so as to parallel to and spaced from each other along the guide channel S. A light emitting element 20*a* is embedded in the end of the supporting piece 20, a light receiving element 21*a* is embedded in the end of the other supporting piece 21, and a base plate 22 has a circuit for amplifying signals from the light receiving element 21*a*. The base plate 22 is integrally formed with a terminal 22*a* to which is connected a lead 23 connected in turn to a control circuit and a light emitting circuit, not shown. Although the elements 20*a*, 21*a* are separately provided on the supporting pieces 20, 21, respectively, these elements may also be provided on the end part of a common supporting piece in parallel to each other as shown for example in FIGS. 6–8.

The end parts of the supporting pieces 20, 21 are placed near the lower end of the guide channel S and are so set that, as shown in FIG. 5, the optical axes of the light emitting element 20*a* and the light receiving element 21*a* are directed towards the guide channel S.

At the time of weft filling, the ends of the supporting pieces 20, 21 are inserted between warp yarns so as to be intruded into the warp shed, as shown in FIGS. 3 and 4. The light is projected at all times from the emitting element 20*a*. In the regular instances wherein the foremost part of the weft yarn Y reaches the outer end of the trimmed waste selvage weft W1 (FIG. 3), the projected light is reflected by the weft yarn Y and the reflected light is received by the light receiving element 21*a*. The converted light signals are transmitted to the control circuit. Hence, the weft insertion is regarded to be regular and the weaving operation is continued. If for some reason the end of the yarn Y has not reached the set position of the weft sensor 18, there is no reflection of the projected light from the weft yarn Y so that the converted light signals are not outputted from the light receiving element 21*a* towards the control circuit. This is regarded as indicating weft filling failure and the driving of the jet loom is discontinued.

In high speed looms, such as jet looms, the loom operation is halted after inertial rotation of the loom for some time duration for fear that abrupt cessation of the operation may cause the failure of the movable loom parts. Thus, there is the risk that, during such inertial loom operation, not only the yarn that has failed in insertion but the next succeeding yarn may be inadvertently woven into the cloth. For removing the inadvertently woven weft yarns, it becomes necessary to remove the weft yarn which is woven into the cloth in contiguous relation to the failed yarn by an extremely laborious operation with resulting lowered efficiency of the loom operation. Therefore, by the early detection of the failure in weft insertion within the cloth width, as in the present embodiment, the loom operation can be stopped at a correspondingly early opportunity, so that the operation of stopping the loom is facilitated. Since the weft detection occurs within the extent of the cloth width, weft detection can be achieved before inserting excess weft yarns for avoiding wastage of the weft yarns. In addition, in what is called an end failure in which the end of the weft yarn Y has not reached the position of the waste selvage W1 of the woven cloth W but the cloth is woven in the regular condition, or in which the cloth as a whole is regarded to be sound in structure despite some local defects in the cloth ends, the weft yarn Y is detected by the weft sensor 18 provided at the innermost warp yarn T of the woven cloth W, so that the loom operation is continued. In this manner, the operational efficiency is not lowered, while the cloth quality is not degraded because the percentage of occurrence of the weaving bar at the time of the cessation and start of the loom operation is lowered.

According to the preferred embodiment of the present invention, since the light emitting and receiving sections are separately provided on the ends of the supporting pieces 20, 21 spaced apart along the guide channel S, the light emitting and receiving sections 20*a*, 21*a* can be made to approach to the same extent towards the guide channel S designed to guide the travel of the weft yarn Y, so that the accuracy in the weft detection is increased. Moreover, a portion of the warp yarns T engaged by the supporting pieces 20, 21 is intruded into the space between the supporting pieces 20, 21 so that a more uniform warp engagement is achieved. Therefore, no stripes are formed in the cloth W along the warp yarns so that the woven cloth W is not degraded in quality.

Also, since the mounting position of the yarn sensor 18 can be adjusted in the attachment position thereof along the slay 11, the yarn sensor 18 can be easily changed to a desired position in dependence upon the selected cloth width.

As described in detail hereinabove, since the light emitting and receiving sections can be intruded into the warp shed within the range of the cloth width, it is possible to make an early detection of the failure in weft insertion so as to accordingly control the subsequent loom operation, while it is also possible to continue loom operation on the occurrence of what is called an end failure, that is, a failure in weft insertion that does not affect the cloth quality, with a resultingly improved operational efficiency. In addition, the chance of the occurrence of the weaving bar that is likely to take place upon halting the loom operation can be reduced for improving the cloth quality and avoiding the wastage of the weft yarn.

In the present embodiment, the support pieces carrying photo-electric elements are intruded into the warp shed. In the instances wherein the support pieces need be reduced in thickness to the extent that the pieces can engage the warp yarns so as to be intruded into the warp shed, it becomes necessary that severe vibrations proper to the loom be taken into consideration. Thus, in order to reduce the thickness of the supporting pieces, it becomes necessary for these pieces to be rigid enough to prevent deflection of the photo-electric elements under the severe vibrations proper to the loom. To this effect, the supporting pieces are preferably formed of rigid materials, such as ferrous material. However, when the supporting pieces are formed of rigid materials, it becomes necessary to provide for insulation between these pieces and the photo-sensors embedded therein, so that it is imperative that an insulator be interposed between the pieces and the photo-sensors. In this case, however, the thickness of the supporting pieces is necessarily increased at the portions thereof where the photo-sensors are embedded, thus causing an injury to the warp yarns at the time of intrusion into the space between the warp yarns and forming stripes in the woven cloth.

Figure 6:
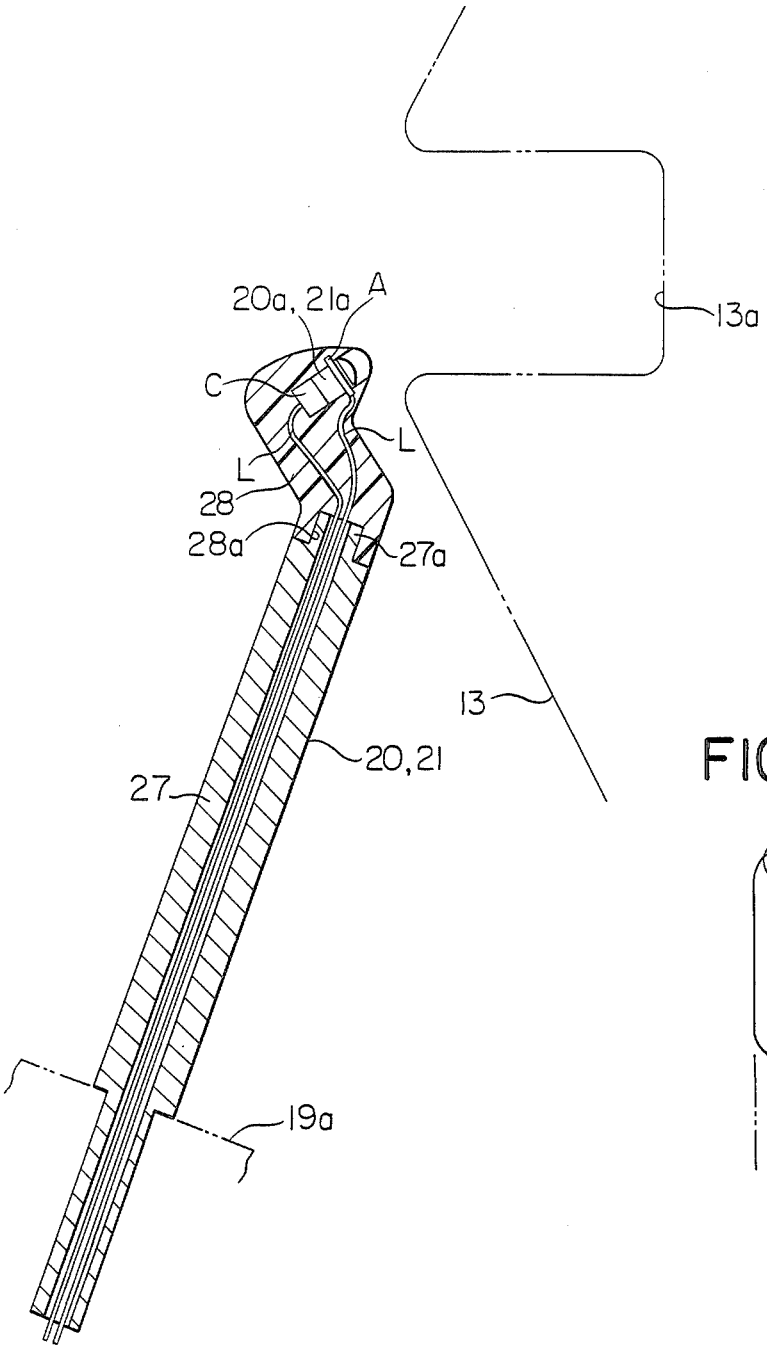
FIG. 6 is a longitudinal sectional view showing a modification of the supporting piece employed in the detection apparatus.
Figure 7:
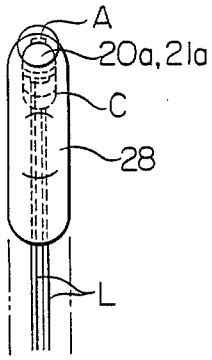
FIG. 7 is a partial front view showing a photo-sensor enclosing section of the supporting piece shown in FIG. 6.

In a modified embodiment shown in FIGS. 6 and 7, the proximate or attachment ends of the supporting pieces are formed of a rigid material while the distal ends thereof, where the photo-sensors are embedded, are formed of an insulating material. When the proximate ends of the supporting pieces are formed of rigid materials, such as ferrous materials, sufficient rigidity can be afforded to the supporting pieces to prevent the photo-sensors from being deflected under the severe vibrations to which the loom is subject and hence to prevent the lowering of the weft yarn sensing accuracy due to the vibrations of the photo-sensors. In addition, by connecting the insulators and the photo-sensors enclosed therein to the ends of these supporting pieces, it becomes unnecessary to provide for insulation between the rigid electrically conductive material and the photo-sensors so that a sufficient insulation may be assured without increasing the thickness of the supporting piece portions enclosing the photo-sensors. Therefore, when the supporting pieces are intruded into the warp shed, the warp is prevented from riding on the ends of the supporting pieces by virtue of the reduced thickness thereof in the direction perpendicular to the warp direction, so that the warp yarns can be easily engaged without injury. The distance between the adjacent warp yarns at the time intrusion of the supporting pieces is reduced so that there is no risk of stripe formation in the warp direction.

More specifically, referring to FIG. 7, the supporting pieces 20, 21 are provided with a cathode C and an anode A, and a lead L, electrically connected to the lead 23, FIG. 3, is connected to the cathode C and the anode A. It is the cathode C and the anode A that need be insulated from other conductors. The supporting pieces 20, 21 enclosing the photo-sensors 20*a*, 21*a* are similarly configured and, as shown in FIG. 6, the bottom side tubular attachment section 27 is formed of a rigid material such as stainless steel, while the distal side section 28 enclosing the photo-sensors is formed of an insulating material such as nylon, bakelite or Duracon (registered trade mark). The photo-sensor enclosing section 28, FIG. 7, is molded in advance with the photo-sensors 20*a*, 21*a* enclosed therein, and can be firmly secured to the bottom section 27 with a projection 27*a* of the bottom section 27 fitted into a mating bottom recess 28*a* in the enclosing section 28.

In the above described structure of the supporting pieces 20, 21, by virtue of the rigidity of the attachment section 27, a sufficient rigidity can be achieved to prevent deflection even under the severe loom vibrations despite the markedly reduced transverse width in the direction perpendicular to the warp direction, so that there is no risk of deflection of the photo-sensors 20*a*, 21*a* likely to cause the weft detection accuracy to be lowered. In addition, the photo-sensors 20*a*, 21*a* in the enclosing section 28 connected to the end of the electrically conductive attachment section 27 can be positively insulated from the attachment section 27 by virtue of the insulating properties of the enclosing section 27. In this manner, the enclosing section 28 can be configured with a minimum width matched to the size of the photo-sensors 20*a*, 21*a* and, by having the width of the enclosing section 27 matched to that of the enclosing section 28, the supporting pieces 20, 21 in their entirety can be configured to thrust the warp yarn so as to be intruded into the warp shed. Therefore, when the supporting pieces 20, 21 are introduced into the warp shed after beating, the warp yarns T can be smoothly set aside without riding on the ends of the supporting pieces 20, 21 so that damage to the warp yarn T may be avoided. Because of the reduced distance between the warp yarns at the time of intrusion of the supporting pieces, there is no risk of streak formation in the warp direction of the woven cloth.

Figure 8:
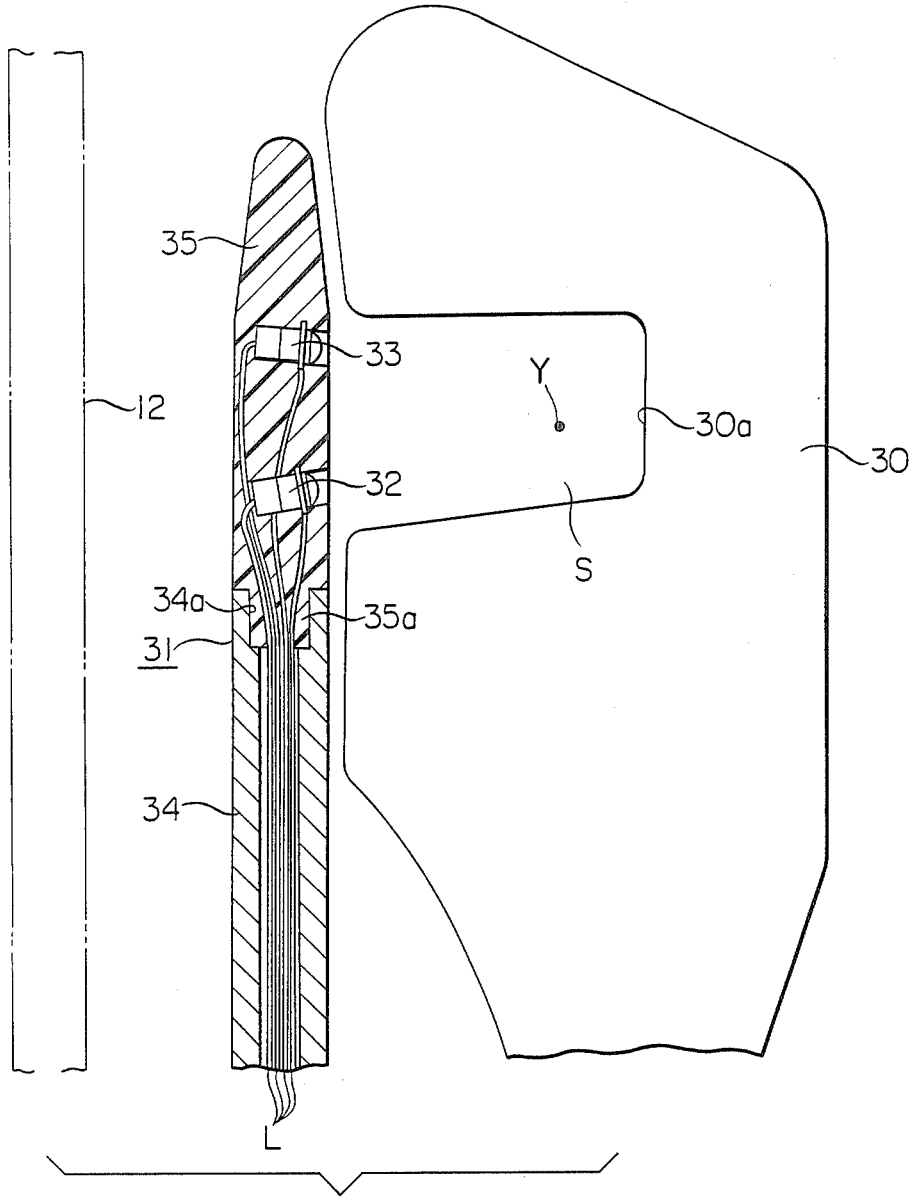
FIG. 8 is an enlarged sectional view showing essential parts of another embodiment of the detection apparatus.

The present invention is not limited to the above embodiments, but can be applied to a known type of jet loom in which the weft yarn guide passage S is defined by the row of guide apertures 30*a* of a large number of the weft guide members 30 provided upright in front of the reed 12, as shown in FIG. 8. In the present embodiment, there is provided upright at the yarn exit opening towards the reed 12 a supporting bar 31 in the end part of which are enclosed a light emitting element 32 and a light receiving element 33 in vertical alignment with each other. The supporting bar 31 is made up of a tubular attachment section 34 formed by rigid members such as stainless steel and a photo-sensor enclosing section 35 formed by an insulating material, as in the preceding embodiment, the two sections being rigidly connected and secured to each other with the engagement projection 35*a* at the lower end of the enclosing section 35 fitted and secured to the engagement recess 34*a* in the end part of the attachment section 34.

In the weft detection device relevant to the present invention, weft detection accuracy is approximately inversely proportionate to the square of the distance between the light emitting elements or that between these elements and the weft yarn, so that it is preferred to reduce these distances to as small values as possible. In fact, it has been envisaged in the prior art to satisfy this condition. However, the light emitting and receiving elements need be provided in the vicinity of the lower part of the weft guide passage so that these elements will not be contacted with the cloth fell at the time of beating and the weft yarn Y will be extricated without hindrance out of the weft guide passage. Thus, because of consequent spatial limitations, the above conditions cannot be met. Hence, not only in the more customary case wherein the optical axes of the elements are parallel to each other, but in the more specific case wherein the optical axes are arranged to intersect each other to elevate weft yarn detection accuracy, optimal detection accuracy may not be achieved because of fluctuations in the properties of the elements or the difference in behavior of the filled weft yarns caused in turn by changes in the yarn description or denier, thus including frequent errors in yarn detection. Such error in detection may cause unnecessary cessation of the loom operation resulting in the lowered operating efficiency of the loom and the increased rate of the concomitant weaving bars.

This problem is more apparent in low capacity light emitting and receiving elements attached to the weft yarn sensors adapted to engage the warp yarns so as to be intruded into the warp shed.

According to the third embodiment of the present invention, the light emitting and receiving elements are provided on one and the other ends of a pair of supporting pieces, respectively, these supporting pieces being spaced from each other and arranged side by side along the guide channel provided at the front side of the reed. The pieces are attached to the attachment member secured to the sley, with at least one of the supporting pieces being mounted for adjustment in the orientation thereof so that the orientation of said at least one optical axis of the light emitting and receiving elements may be adjusted as desired.

The behavior of the weft yarn inserted by the entraining fluid into the weft guide passage differs with the difference in the description or denier of the yarn. The light reflection by the weft yarn and the light reception by the light receiving element can be optimized by adjusting the orientation of the supporting pieces in accordance with such behavior for correspondingly changing the direction of the optical axes of the pieces for assuring positive weft detection. In this manner, any unnecessary cessation of the loom operation due to errors in the weft yarn detection may be avoided for improving the operating efficiency and possibly reducing the rate of occurrence of the weaving bars caused by the cessation of the loom operation.

Figure 9:
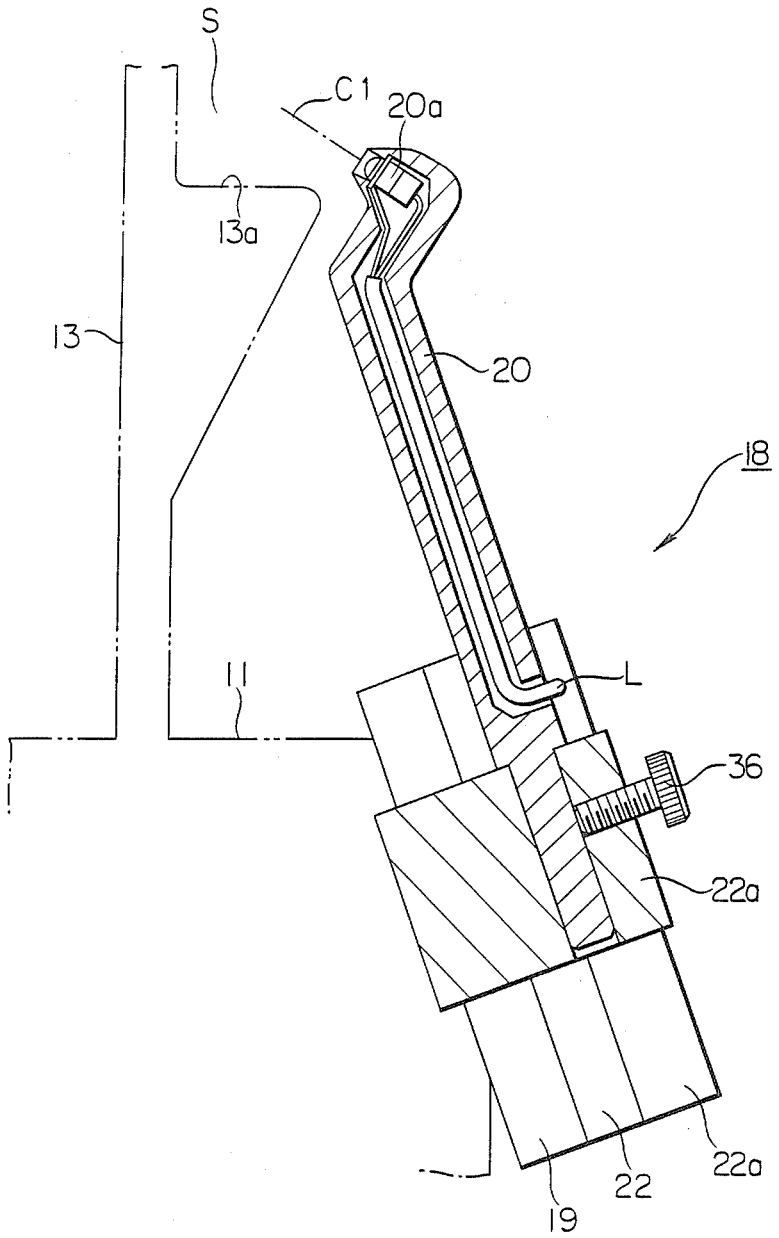
FIG. 9 is a longitudinal sectional view of a loom, when viewed from the upstream side relative to the weft inserting direction.
Figure 10:
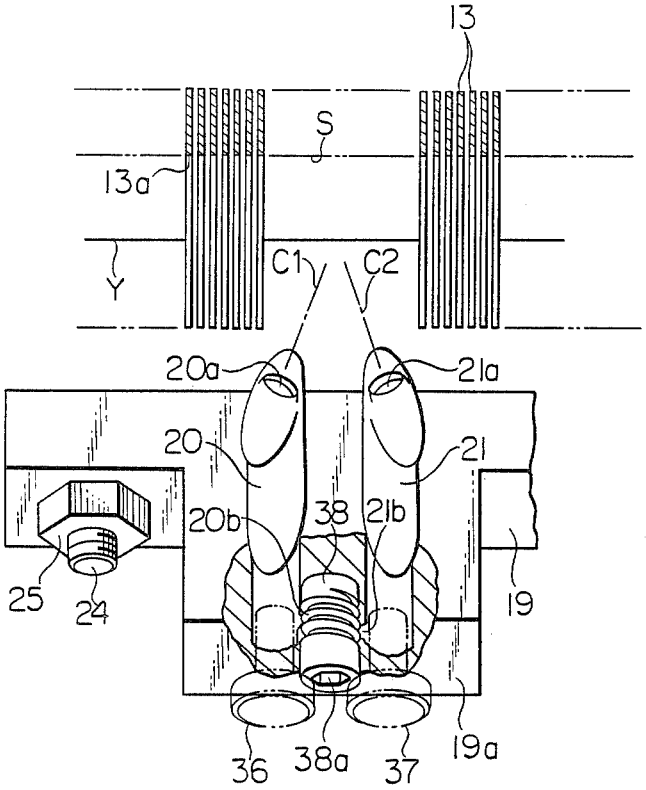
FIG. 10 is a plan view showing a modification of the supporting piece, with part being broken away.

The third embodiment of the present invention will now be explained only insofar as it is different from the first embodiment shown in FIG. 3. A lead L connected to the elements 20*a*, 21*a* as shown in FIG. 9 (only element 20*a* being shown) is taken out at the back bottom end via a groove in the supporting pieces 20, 21 so as to be electrically connected to the circuit board 22 (FIG. 3). The supporting pieces 20, 21 are so oriented that the optical axes C1, C2 of the light emitting and receiving elements 20*a*, receiving 21*a* intersect each other, as shown in FIG. 10.

At the time of weft filling, the ends of the supporting pieces 20, 21 move the warp yarns aside so as to be intruded into the warp shed, as shown in FIG. 3. The light is projected at all times from the light emitting element 20*a*. In the case of the regular, weft insertion wherein the leading end of the weft yarn Y reaches the outer end position of the waste selvage W1, the projected light is reflected by the weft yarn Y and the reflected light is received by the light receiving element 21*a*. The corresponding electrical signal is transmitted to the above described control circuit. Thus the weft insertion is regarded to be regular and the weaving operation is continued. If, for some reason, the end of the weft yarn Y has not reached the preset position of the weft sensor 18, reflection of the projected light by the weft yarn Y is not caused and the corresponding signals are not transmitted from the light receiving element 21*a* to the control circuit. By this, the failure in the weft yarn insertion is assumed to have taken place and the loom operation is discontinued.

When the description or the number of denier of the weft yarn is changed, the weft yarn in the guide channel S shows a behavior different from that of the preceding yarn Y. Therefore, if the photo-sensors 20*a*, 21*a* should proceed to detect the new yarn with the orientation of the optical axes C1, C2 of the elements remaining unchanged, the amount of the light received at the element 21*a* may fail to reach the designed detection level despite the correct weft insertion owing to the fact that the light is reflected by the new yarn showing a different behavior from that of the weft yarn Y. In the present embodiment, screws 36, 37 are loosened and the supporting pieces 20, 21 turned inwardly as shown in FIG. 9 and in dotted lines in FIG. 10 thereby turning the supporting pieces 20, 21 inwards so that a light volume higher that the preset detection threshold volume may reach the receiving element when the new changed yarn is inserted under regular conditions as shown in FIG. 10. In this manner, the optimum weft yarn detection state can always be set as a function of the kind and the number of denier of the weft yarn so that there is no necessity for stopping the loom operation upon the occurrence of the failure in weft insertion. In this manner, the loom can be driven at a higher efficiency and the chance of the occurrence of weaving bars may be reduced.

The accuracy in the detection of the weft yarn can be affected not only by changes in the kind or the number of denier of the weft yarn but the different behavior in the weft yarn guide channels S caused by the fluctuations in the properties of the photo-sensors or the changes in the cloth width of the woven cloth. It is to be noted that any of these situations can be successfully overcome by the weft yarn detecting apparatus of the present invention.

In the present third embodiment, the supporting pieces 20, 21 with the embedded light receiving elements 20*a*, 21*a* are clamped by screws 36, 37 to the attachment section 22*a* of the attachment plate 22 in any desired adjusted position as shown in FIG. 10, while a worm 38 can be fitted into the front side of the attachment section 22*a* so that engagement projections 20*b*, 21*b* on the bottom side sections of the supporting pieces 20, 21 may be engaged with the helical groove of the worm 38. With the screws 36, 37 untightened, a hex wrench is engaged in a hex hole 38*a* for adjusting the meshing of the worm 38 to cause the supporting pieces 20, 21 to be revolved in the mutually opposite directions for changing the orientation of the optical axes C1, C2 of the light receiving elements 20*a*, 20*b* in the desired manner. The adjustment operation of the optical axis orientation for the photo-elements may be facilitated by providing graduations on the front side of the attachment section 22*a*.

According to the present invention, only one of the supporting sections can be made adjustable in rotation or both of the photo-elements can be made adjustable in height.

Figure 1:
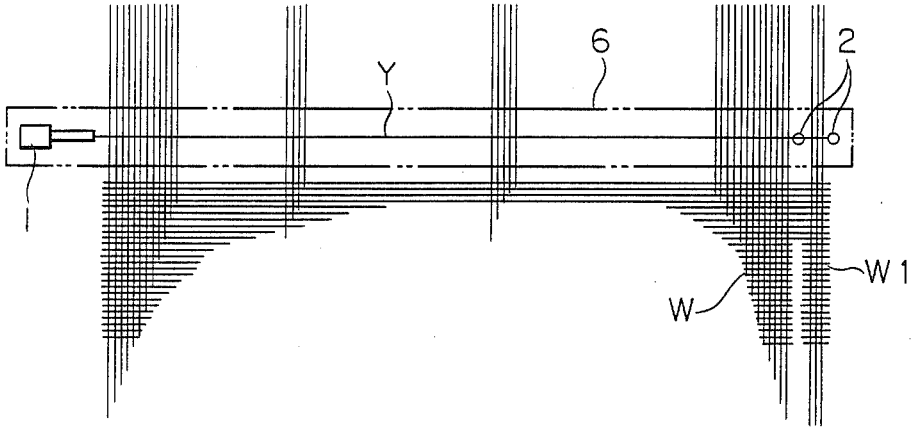
FIG. 1 PRIOR ART
FIG. 1 is a diagrammatic plan view of the loom especially showing the arrangement of the prior-art weft yarn sensor.

As described hereinbefore, in the weft yarn detection system in which the light emitting or receiving elements are attached to the ends of the supporting pieces that can engage the warp yarns and intrude into the warp shed so that the weft yarn will be detected within the warp shed, it is necessary that the supporting piece thickness be as small as possible so as to facilitate intrusion of the supporting pieces into the warp shed. For this reason, the photo-sensors attached to the supporting pieces are necessarily compact in size so that the function of the sensor is unavoidably lowered. When employing such small-sized photo-sensors for detecting the weft yarn, it may be presumed that the electric current obtained upon detection of the slender object such as weft yarn is low and the direction of the optical axes of the photo-sensors may desirably affect the accuracy in weft detection in conjunction with the environment, such as extraneous light from a fluorescent lamp or the characteristic movement of the weft yarn. This is because, in distinction from the conventional device explained by referring to FIGS. 1 and 2, the accuracy in weft yarn detection is elevated by increasing the light volume change and thereby producing larger changes in the electrical current.

Thus, according to a fourth embodiment, there is provided means for positively sensing the weft yarn not only within the warp shed but also exteriorly of the woven cloth. To this effect, a photo-sensor of a reflection type light emitting and receiving device, adapted to detect the weft yarn carried by the jet fluid through the weft guide channel provided on the front side of the reed, is placed in the vicinity of the exit opening of the weft guide channel, and the optical axis of the photo-sensor is directed to be within the lower portion of the weft guide channel with respect to the center of the inscribed circle of the wall surface providing the yarn guide channel.

By directing the optical axis of the photo-sensor in this manner, there is obtained a detection state with a high yarn detection signal to noise (S/N) ratio. When the weft yarn is to be detected within the warp shed, the photo-sensors having lower properties are necessarily used. Therefore, when changes in the light volume are rather small, the detection state with a larger S/N ratio is critical in distinguishing the weft detection signals from the noise for positively judging the occurrence of the weft detection. The arrangement of the present embodiment provides for an optimum detection state and improved accuracy in weft yarn detection.

Figure 11:
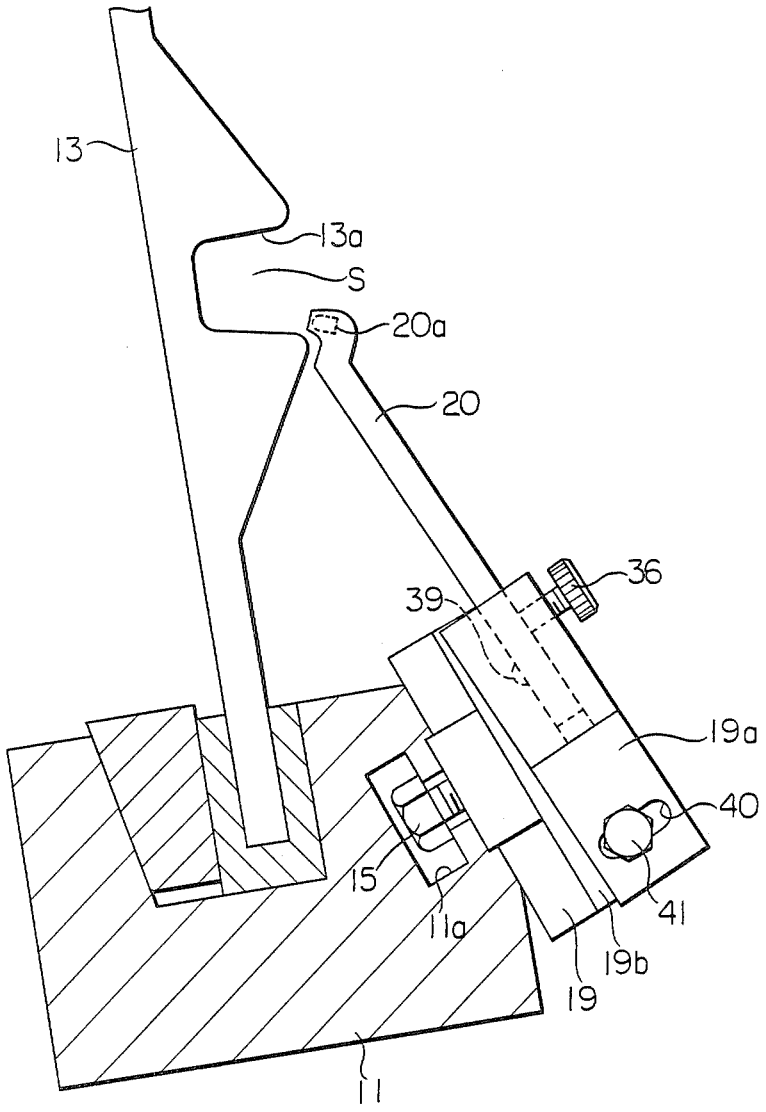
FIG. 11 is a side view of the jet loom of FIG. 3 shown in the weft inserting direction and partially in section.

Referring to FIG. 3, in an attachment section **19*b* projecting from one side of the supporting plate 19 is formed an engagement aperture 19*c* into which a shaft 39 is protuberantly provided from the side of the L-shaped supporting block 19*a*. In the lower portion of the supporting block 19*a* is formed an arcuate opening 40, FIG. 11, which is centered about the shaft 19, and into which is introduced a bolt 41 with a nut 42 for clamping the supporting block 19*a* for adjustment of the rotary position thereof about the shaft 39. To the supporting block 19*a*, a pair of supporting pieces 20, 21 are secured by scews 36, 37, so as to allow for positional adjustment in the vertical direction. The light emitting element 20*a* is embedded at the distal end of the supporting piece 20, while the light receiving element 21*a* is embedded at the distal end of the other supporting piece 21. These pieces 20, 21 are designed with a thickness to engage the warp yarns T so as to be smoothly introduced into the warp shed. The elements 20*a*, 21*a* are designed with a small size to suit the thickness of the supporting pieces. It is noted that the lead L connected to the elements 20*a*, 21*a* as shown in FIG. 12 is connected to a circuit on the board 22 by way of the associated grooves in the supporting pieces 20, 21**.

Figure 12:
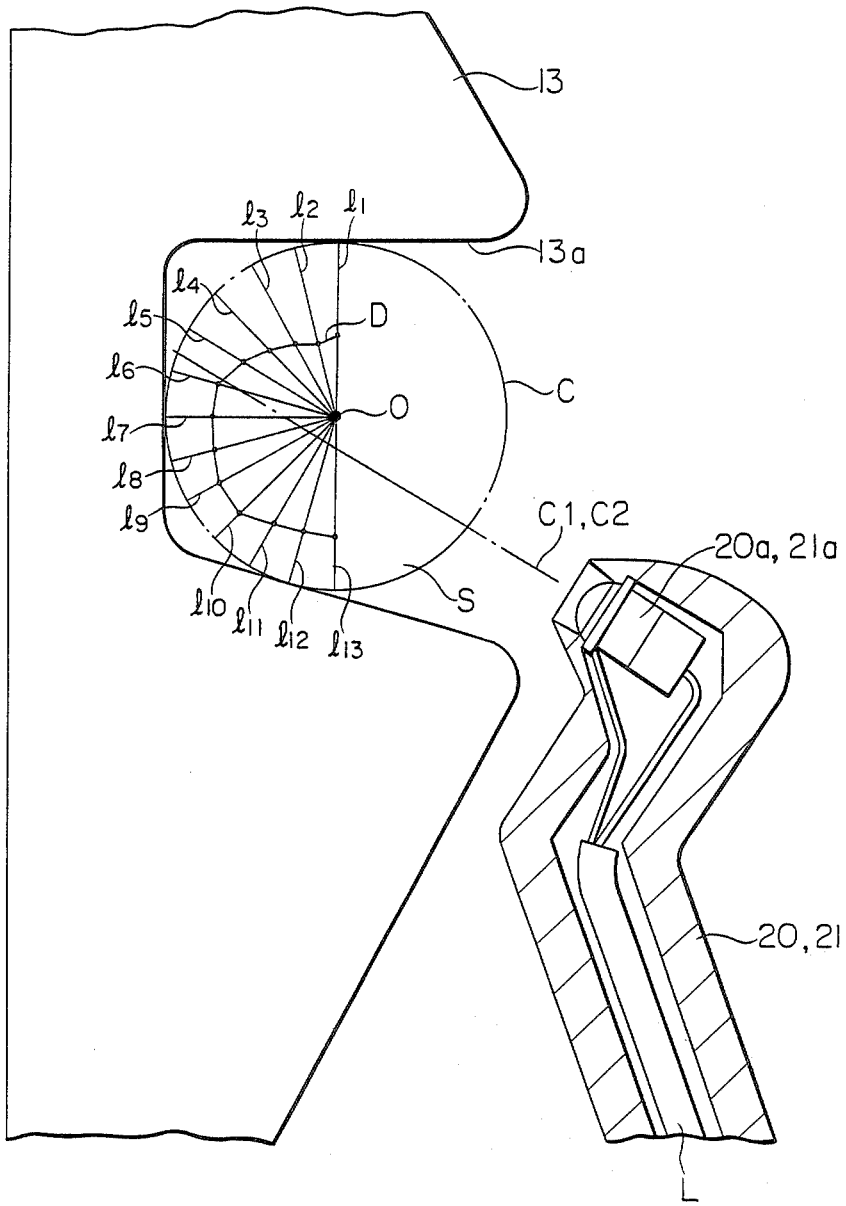
FIG. 12 shows the S/N ratio distribution along the direction of the optical axis of the detection apparatus shown in FIG. 3.

The rotational position of the supporting block **19*a* and the vertical position of the supporting pieces 20, 21 are designed so that, as shown in FIG. 12, the elements 20*a*, 21*a* are positioned in the vicinity of the lower area of the opening of the weft yarn guide channel S and the optical axes C1, C2 of the photo-sensors 20*a*, 21*a* are directed to be within the weft yarn guide channel S including the center O of a circle C inscribed by the three wall surfaces of the guide recess 13*a*** providing the guide channel S. More specifically, the optical axes C1 and C2 are directed to pass through either the center O or at least the third guadrant of the inscribed circle C.

The weft yarn Y impelled into the passage S is entrained by the fluid and thereby activated into the vibrating state. Therefore, the volume of the light received by the sensor **21*a*** is subject to fluctuations. These fluctuations are taken as weft yarn detection signals.

The present inventors conducted investigations as to how the weft detection signals to noise (S/N) ratio is changed with the direction of the optical axes C1, C2 of the photo-sensors **20*a*, 21*a* placed in the vicinity of the lower opening of the guide channel. In order to specify the direction of these elements 20*a*, 21*a*, a circle C inscribed by three wall surfaces of the guide recess 13*a* providing the weft guide channel S was used, and the half-circle portion of the circle C towards the inner wall surface of the weft guide channel S was divided into a plurality of twelve, in the present embodiment, equal parts. The optical axes C1, C2 of the elements were directed towards the respective division points. The distribution of the S/N ratio obtained in this state is shown in FIG. 12 by a line D connecting the dots on the division lines l1 to l13 connecting in turn the division points and the center O. This result shows a common tendency that is not influenced by the kind or the number of denier of the weft yarn. That is, the S/N ratio becomes large when the optical axes C1, C2 of the elements 20*a*, 21*a* are directed to be within the lower guide channel S including the center O of the circle C. This is because the effect of reflection from the upper wall surface is reduced when the elements 20*a*, 21*a*** are arranged in the vicinity of the lower opening of the guide channel S and the optical axes C1, C2 are oriented as described above. Therefore, when the optical axes C1, C2 are oriented as in the present embodiment for detecting the weft yarn, the detection accuracy is improved and, even with the use of the small-sized photo-sensors by which only minute changes in the current are obtainable because the weft detection is performed within the above described range, the weft yarn can be detected accurately.

According to the present embodiment, the direction of the optical axes C1, C2 can be adjusted as a function of changes in the description or the number of changes of the weft yarn.

In addition, in the weft yarn detection system relevant to the present invention, it is necessary that the thickness of the supporting pieces be reduced to a small a value as possible. Therefore, the photo-sensors attached to these pieces are necessarily reduced in size. The weft yarn detection device according to the fifth embodiment of the present invention is capable of positively detecting the weft yarn within the extent of the warp shed even under these size constraints.

According to this fifth embodiment, a pair of supporting peices capable of engaging the weft yarn and intruding into the warp shed are arranged side-by-side along the guide channel so that the warp yarn can be inserted into the space between these supporting pieces. The light emitting element is provided on the end of one of the supporting pieces and the light receiving element is provided on the other piece, these elements being arranged in the vicinity of the yarn exit opening side of the guide channel. The optical axes of the light emitting and receiving elements are directed parallel to each other and into the guide channel. The distance between the incipient points of the optical axes is set so as to be less than 5 mm, while the distance between the incipient points of the optical axes and the point of intersection between the optical axes and the wall surface of the guide channel is set so as to be 8 to 13 mm.

Since the pair of supporting pieces capable of intruding into the warp shed are arranged side-by-side along the weft guide passage, the engaged warp yarn can be partially introduced into the space between these pieces to provide for more uniform warp yarn engagement. The result is that the intrusion into the warp shed of the supporting pieces can be effected smoothly for avoiding damage to the warp yarn and stripe formation on the cloth in the warp direction. By setting the distance between the intersection of the optical axes with the wall surface of the weft guide channel and the incipient point of the optical axes of the elements arranged in the vicinity of the exit opening side of the weft yarn guide channel so as to be 8 to 13 mm, and the distance between the incipient points of the optical axes so as to be less than 5 mm, the aforementioned distance can be maintained between the supporting pieces. In addition, only by setting the optical axes of the light emitting and receiving elements so as to be substantially parallel to each other without regard to the description or the number of denier of the weft yarn, the weft yarn detection can be attained with good accuracy.

Figure 13:
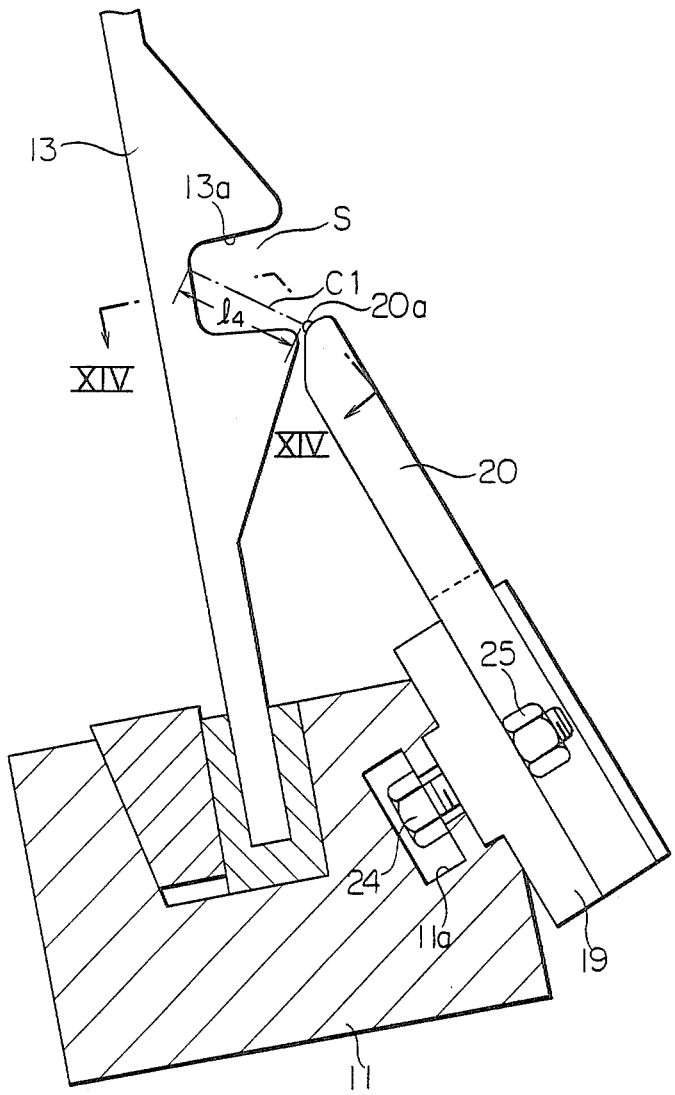
FIG. 13 is a side view showing the loom having another embodiment of the detection apparatus of the present invention and shown from the upstream side in the weft inserting direction.
Figure 14:
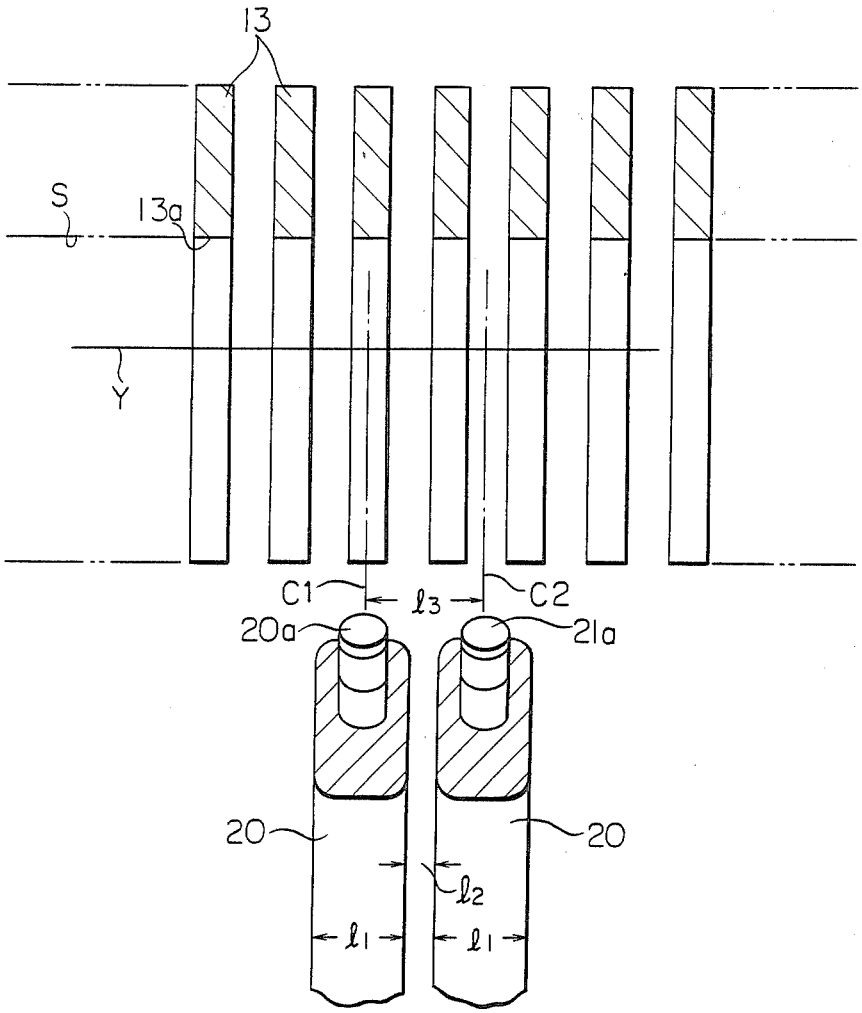
FIG. 14 is a sectional plan view along line XIV—XIV of FIG. 13.

More specifically, according to the fifth embodiment shown in FIGS. 13 and 14, the pair of supporting pieces 20, 21 are arranged side-by-side along the guide channel while the optical axes C1, C2 of the photo-sensors 20*a*, 21*a* attached to the ends of the supporting pieces 20, 21 are designed to be substantially parallel to each other. The thickness l1 of the supporting pieces 20, 21 along the guide channel S is designed to be less than 4 mm so that the supporting pieces will be able to pass through the warp yarns so as to be smoothly introduced into the warp shed, while the distance l2 of the spacing between the pieces is set above 0.5 mm. The distance l3 between the incipient points of the optical axes C1, C2 is designed to be less than 5 mm. The distance l4 in FIG. 13 between the incipient points of the optical axes C1, C2 with the wall surface of the guide recess 13*a* of the guide channel S is set so as to be 8 to 13 mm.

By setting the thickness l1 and the distance l2 as above, the supporting pieces 20, 21 can be smoothly introduced into the warp shed without damaging the warp yarn T while the engaged warp thread T is partially introduced into the gap between the supporting pieces 20, 21 to provide for more uniform warp yarn engagement while avoiding longitudinal stripe formation on the woven cloth W. The distance l2 between the supporting pieces 20, 21 is set in consideration that thick yarn may occasionally be used as the warp yarn.

The distance l4 has been set in consideration of the size and shape of the guide recess 13*a* of the known type reed teeth 13, while the distance l3 has been set in consideration of the distance l4 and the properties of the photo-sensors 20*a*, 21*a* of the size enclosable within the thickness l1 of the supporting pieces 20, 21. In sum, the present inventors have discovered that, under these conditions, weft yarn detection signals by which one can safely assume the detection of the weft yarn can be obtained by simply setting the optical axes C1, C2 so as to be substantially parallel to each other and thus without specifically setting the optical axes C1, C2 in relation to the description or denier of the weft yarn.

Figure 15:
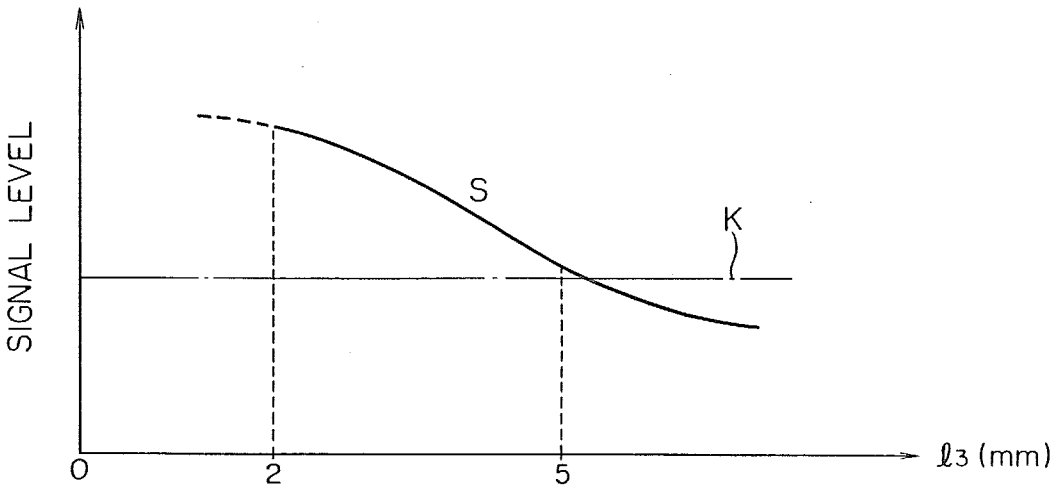
FIG. 15 is a diagram showing the relation between the signal level and the distance between the parallel optical axes.

FIG. 15 shows the data of our investigations into the range of the distance l3 for which the signal level K necessary for weft yarn detection can be obtained when the distance l4 is set to 10 mm. It is seen from this figure that an output signal curve S exceeds the level K in the range of $l3 \leqq 5$ mm. With l4 larger than 10 mm, the signal level for the output signal curve S is decreased. However, for $l4 = 13$ mm, the distance l3 up to 5 mm may be used without dropping below the level K. When the weft is detected within the warp shed as in the present embodiment, the value of l2 for which smooth warp yarn engagement can be obtained is not assured for $l3 \leqq 2$ mm. Therefore, the range of $2\text{ mm} \leqq l3 \leqq 5$ mm is preferred in the case of weft yarn detection within the warp shed. Hence, by previously setting the conditions as defined above, weft yarn detection can be attained at all times with higher accuracy without the laborious operation of matching the optical axes even in instances wherein the kind or number of denier of the weft yarn should be changed.

According to the present invention, there is also provided a method for detecting the weft yarn travelling in the guide channel under the force of the jet fluid.

Figure 16:
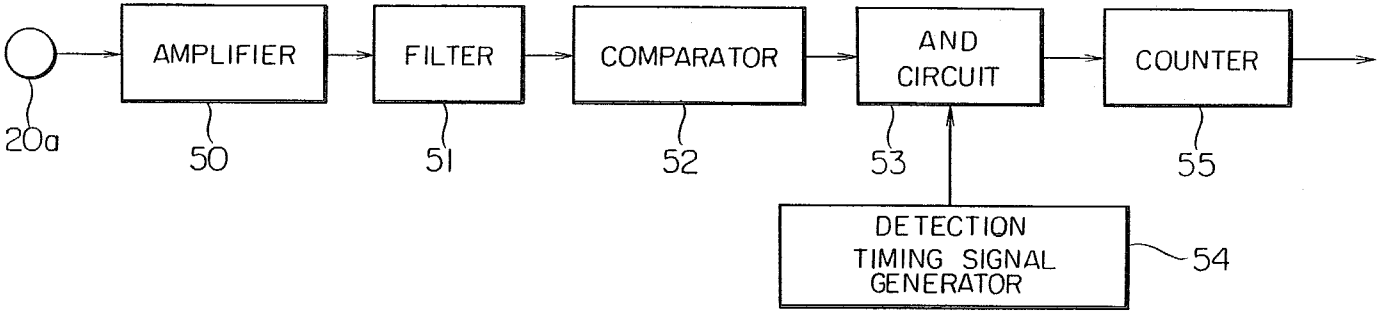
FIG. 16 is a block diagram showing an electrical circuit for practicing the method of the present invention.
Figure 17:
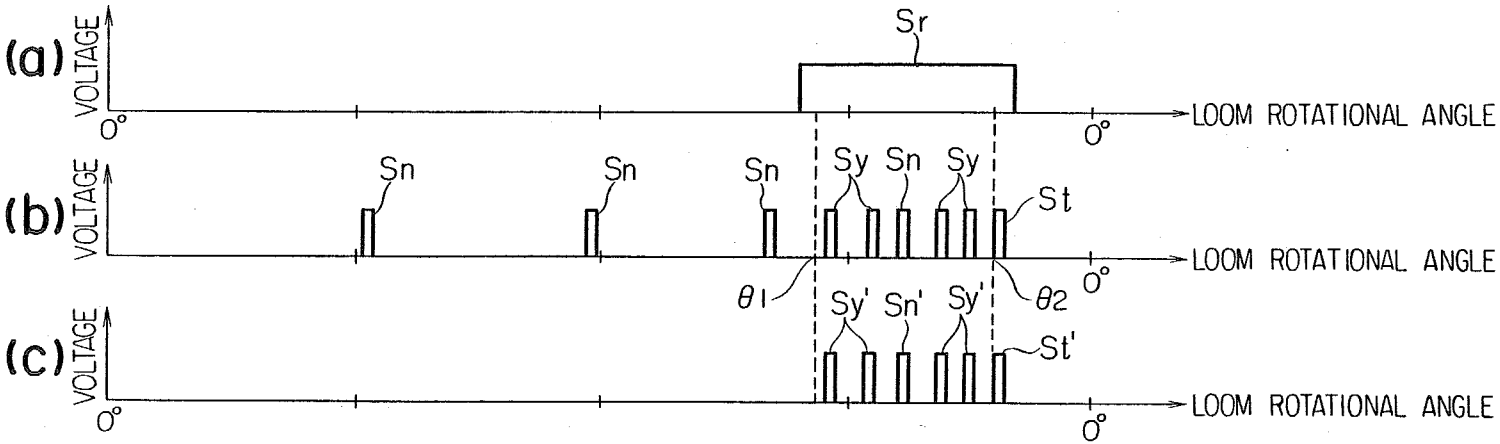
FIGS. 17(*a*) to (*c*) are waveform diagrams for various signals for explaining the method of the present invention.

This method is now explained by referring to FIGS. 4, 16 and 17. At the time of the weft insertion, the ends of the pieces 20, 21 engage the warp yarns T and are intruded into the warp shed. The light is projected at all times from the photo-sensor 20*a*. At this time, the warp yarns T engaged by the pair of supporting pieces 20, 21 are partially introduced into the space between the pieces 20, 21. In the regular weft insertion, that is, when the end of the weft yarn Y has reached the outer end of the waste selvage W1, the projected light is reflected to the light receiving element 21*a*. At this time, the weft yarn Y is entrained by the jet fluid within the guide passage S and thereby activated into the vibrating state. Therefore, even in the instance when the end of the weft yarn Y has reached the mounting position of the weft sensor 18, the volume of the light received by the photo-sensor 21*a* is changed and may be sensed as signals.

After weft insertion, the slay 11 is advanced to beat the just inserted yarn. Then, as shown in chain-dotted lines in FIG. 4, the photo-sensors 20*a*, 21*a* at the ends of the supporting pieces 20, 21 are moved to a lower region of the warp shed by way of the lower warp yarns that are moved to form the shed of warps. Therefore, the warp yarn previously introduced into the space between these pieces will travel through the space between the photo-sensors 20*a* and 21*a* effectively to position T1 to cause changes in the received light volume.

The changes in the light volume may also be caused by the detection of flying cotton as well as by the weft and warp yarns described above. The output signals from the light receiving sensor 21*a* may also be changed by noises. The weft yarn detection signals, the flying cotton detection signals or the noise are amplified in the amplifier circuit 50 as shown in FIG. 16 and thence transmitted to a filter circuit 51 where the noise is removed. The output signals from the circuit 51 are transmitted to a comparator 52 from which preset pulse signals are outputted only in response to an input signal above a preset threshold level. These pulse signals are shown in the chart of FIG. 17(*b*) wherein Sy, St and Sn represent weft yarn detection signals, warp yarn detection signals and the flying cotton detection signals and noise, respectively. These pulse signals are inputted to the AND circuit 53 wherein the logical sum is taken of the pulse signals and the detection timing signal shown at Sr in the chart of FIG. 17(*a*) and inputted from a detection timing signal generating circuit 54. The detection timing signal Sr is designed to be in the range between an angular position slightly before the rotational angle $\theta 1$ in FIG. 17 of the loom at which the end of the weft yarn Y is estimated to reach the location of the weft yarn sensor 18 and an angular position slightly after the rotational angle θ2 in FIG. 17 at which the weft yarn detection signal St is estimated to be issued. As shown by a chart in FIG. 17(*c*), the pulse signal St' as the weft yarn detection signal, is necessarily included in the pulse signals outputted from the AND circuit 53. The pulse signals Sy', St' or Sn' are inputted to the counter 55 where the pulse numbers are counted. If the counted pulse numbers should reach a preset integer N, loom stop signals are not outputted from the counter 55 so that the weaving operation is continued. Conversely, should the counted numbers not reach the integer N, loom stop signals are issued for stopping the loom operation.

The above description of the block circuit of FIG. 16 has been made with reference to the case of using an ordinary light as transmitted light from the sensor 20*a*. In case of using modulated light, a wave detection circuit need be provided between the filter 51 and the comparator 52 of the block circuit shown in FIG. 16.

In such weft detection system, it is necessary that, in the case of the regular insertion of the weft yarn Y, the number of detection pulse signals within the designated range of the yarn Y must be larger than the preset value N, which value N must in turn be larger than the preestimated cotton detection signal and the sum of the noise Sn and the number 1 of the weft detection signal. Therefore, the value N must be properly set in consideration of the noise Sn, cotton detection pulse signal and the weft detection pulse signal Sy in the design range of the signal Sr. This in turn necessitates proper setting of the range of the signal Sr. According to the present embodiment, by setting the signal Sr so as to be within a larger range inclusive of weft yarn detection pulse signal St without regard to the cloth width, the number of detection pulse signals can be sufficiently large in case of regular weft filling so that the number becomes positively larger than the aforementioned preset value. For example, in case of a larger cloth width, it takes some time until the end of the weft yarn Y reaches the location of the sensor 18, so that the time interval between the time the yarn end reaches the sensor 18 and the time the weft selection signals are produced is reduced. However, the number of the detection pulse signals included within the range of the signal Sr is sufficiently large to permit one to assume a weft yarn detection with inclusion of the warp detection signals and larger than a design value inclusive of the warp signal which is one. Therefore, weft detection is performed positively, so that unnecessary cessation of the loom operation is avoided.

After the inputting of the weft detection signal St, the circuit of FIG. 16 becomes saturated with noise reduction and elimination of the adverse effect on the weft detection accuracy. This is convenient in setting the range of the signal Sr inclusive of the weft yarn detection signal.

Figure 2:
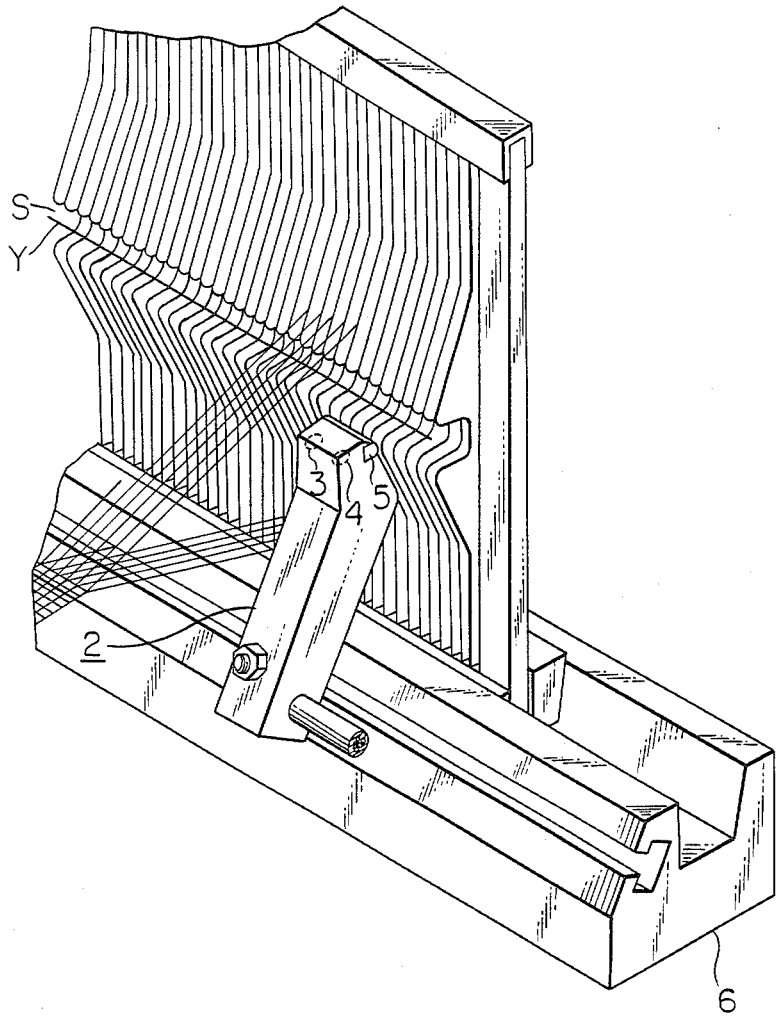
FIG. 2 PRIOR ART
FIG. 2 is a perspective view of the prior-art weft yarn sensor.

In the conventional weft yarn detection system shown in FIG. 2, the weft yarn Y in the guide passage S is activated by the jet fluid into the vibrating state. Therefore, the volume of the light received by the light receiving element 4 in FIG. 2 is subject to fluctuations, so that the output signal from the light receiving signal 4 is as shown at S1 in FIG. 22(*a*). This signal is amplified in the amplifier 56 (FIG. 21), thence transmitted to the filter 57 for noise removal, and detected in the detector 58. The signal S2 in FIG. 22(*b*) is the signal obtained after amplification of the signal S1, the signal S3 in FIG. 22(*c*) the signal obtained after noise removal and the signal S4 in FIG. 22(*d*) the signal obtained after detection. The detected signal S4 is transmitted to the amplifier 59 and the amplified signal S5 shown in FIG. 22(*e*) is integrated in an integrating circuit 60. The integrated signal S6 shown FIG. 22(*f*) is compared to the preset reference level signal shown at L in FIG. 22(*f*) stored in the comparator 61 so that, when the signal S6 exceeds the level L, the weaving operation is continued and, when the signal S6 does not reach the reference signal level L, the weft yarn reach signal S7 as shown in FIG. 22(*g*) is outputted.

Figure 21:
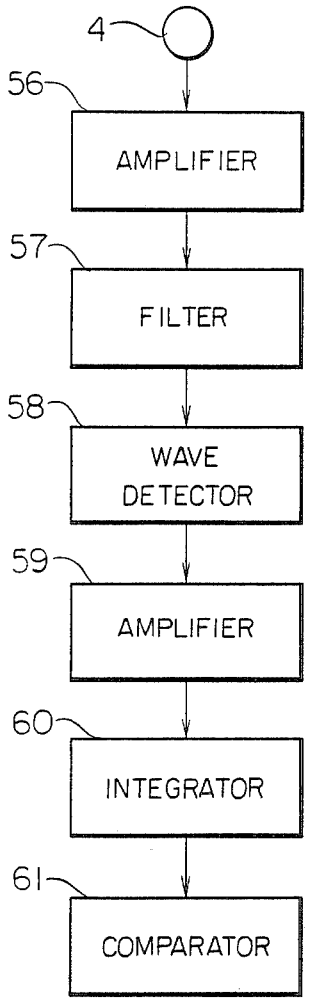
FIG. 21 PRIOR ART
FIG. 21 is a block diagram of a conventional weft yarn detection circuit.
Figure 22:
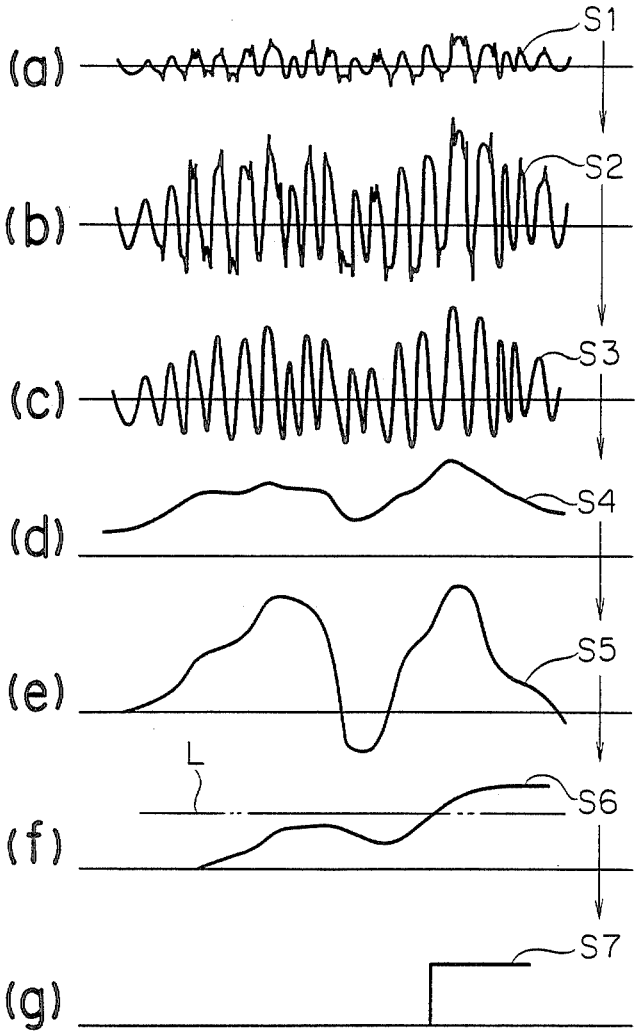
FIG. 22 PRIOR ART
Figure 23:
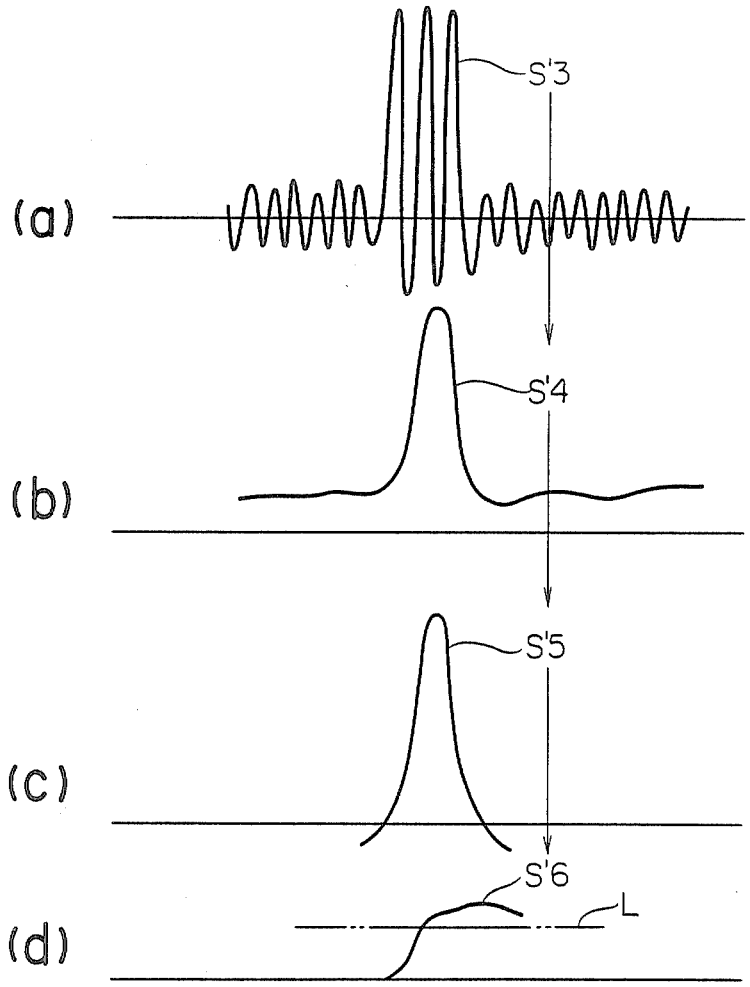
FIG. 23 PRIOR ART
FIGS. 23(*a*) to (*d*) are diagrams showing the various processing stages of the signals for dealing with larger changes in the light volume in the conventional method for detecting the weft yarn.

However, the conventional weft yarn detection circuit shown in FIG. 21 has the following defects. In case of the failure in weft insertion, in which the weft yarn has failed to reach the location of the weft yarn sensor, a larger change in the light volume may occasionally be caused due to flying cotton travelling past the detector. Referring to FIG. 23, the signal S'4 obtained after the detection of the signal S'3 corresponding to the larger light volume is amplified and the resulting amplified signal S'5 is integrated to a signal S'6, which signal may occasionally exceed the reference level signal L. See FIGS. 23(*a*) to (*d*). This results in a weft yarn detection error in which the weft reach signal S7 is outputted and the loom operation is continued despite the occurrence of the failure in weft yarn insertion.

According to the present invention, there is further provided a weft yarn detection method in which the signal outputted from the reflection type light emitting and receiving device, making use of modulated light for detecting the weft yarn propelled by the jet fluid within the weft guide passage, is detected by a detection circuit provided ahead of the integrating circuit in the conventional detection circuit shown in FIG. 21. The detected signal is compared to a first reference signal, a preset signal is issued in case the detected signal is larger than said first preset signal, said preset signal is integrated, the integrated signal is compared to a second reference level signal, and the occurrence of weft detection is assumed when the integrated signal becomes higher than the second reference level signal.

According to the present method, even should a larger change in the light volume occur due to detection of flying cotton, the signal corresponding to this larger change in the light volume is compared to the first reference level signal in the comparator so that the amplitude of the light volume signal is replaced by the signal of the same level as the weft yarn detection signal. Therefore, the integrated value of the output signal from the comparator circuit is markedly smaller than the integrated value corresponding to the weft yarn detection signal and less than the second reference level signal. In other words, the second reference signal as the detection boundary for detecting the presence or obsence of the weft yarn between the two integrated values can be set easily so that the weft detection accuracy is improved.

Figure 18:
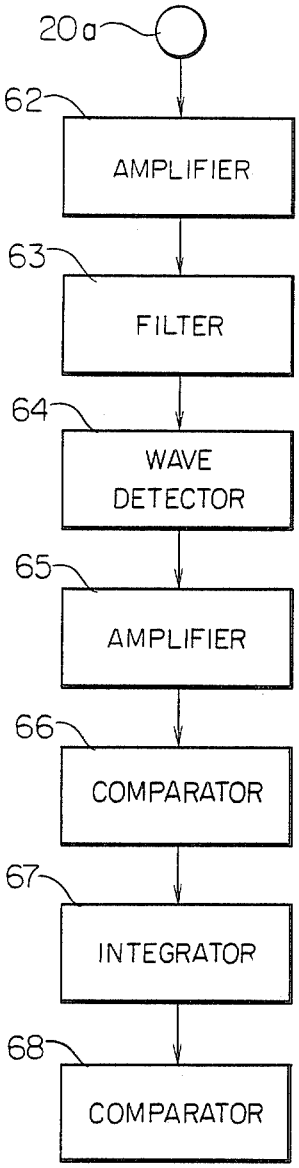
FIG. 18 is a block diagram of the electrical circuit for practicing another method for detecting the weft yarn according to the present invention.
Figure 19:
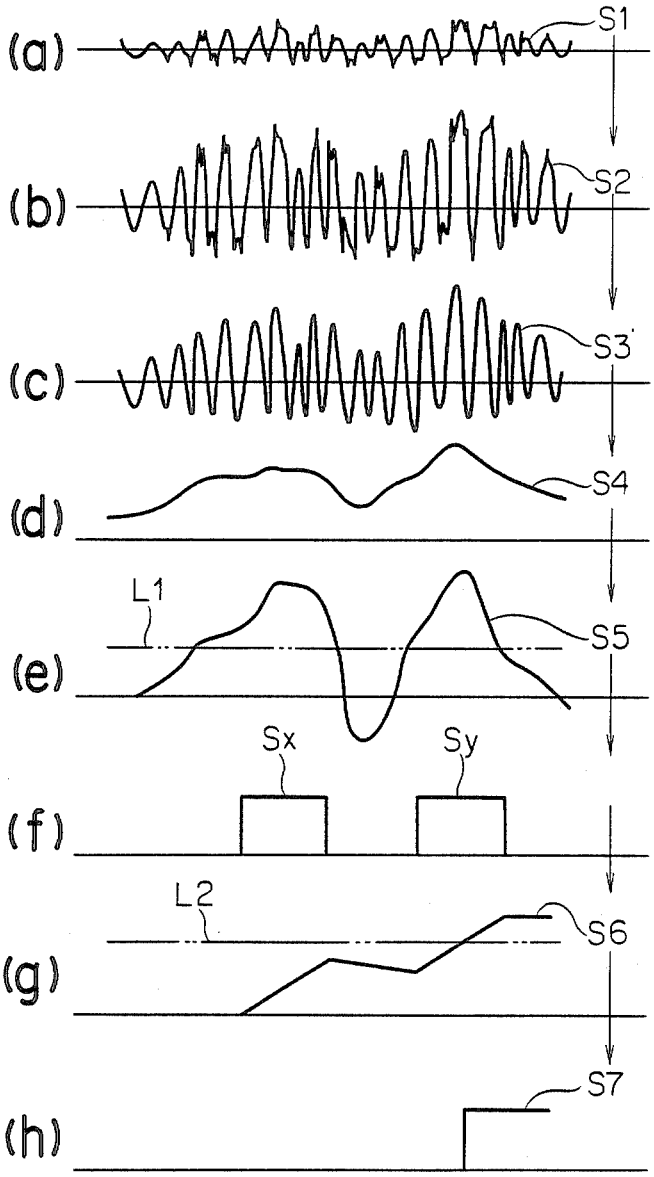
FIGS. 19(*a*) to (*h*) are diagrams showing the various processing stages of the signals for dealing with larger changes in the light volume such as flying cotton detection signals.

This weft yarn detection method is explained by referring to FIGS. 3 and 18–20. At the time of weft insertion, the ends of the supporting pieces 20, 21 engage the warp yarns T so as to be intruded into the warp shed, as shown in FIG. 3. In the instance of regular weft insertion such that the end of the weft yarn Y reaches the outer end of the waste selvage W1, the projected modulated light is reflected by the weft yarn Y, and the reflected light is received by the light receiving element 21*a*. The weft yarn Y in the guide channel S is activated by the jet fluid into the oscillating state so that the volume of the received light is subject to fluctuations. The weft yarn detection circuit is shown in FIG. 18 and the corresponding signals in FIG. 19. The signal S1 is amplified at an amplifier 62 and the amplified signal S2 shown in FIG. 19(*b*) is transmitted to a filter circuit 63 where the noise is removed. The noise-free signal S3, FIG. 19(*c*), is detected by a detection circuit 64 and the detected signal S4, FIG. 19(*d*), is amplified by the amplifier 65. The amplified signal S5, FIG. 19(*e*), is transmitted to the comparator 66 where it is compared to the preset first reference level signal L1. When the signal S5 is above the first reference level signal L1, plural signals of a preset amplitude are outputted. In the illustrated embodiment, two signals Sx, Sy are outputted, FIG. 19(*b*). The signals Sx, Sy are integrated in the integrating circuit 67 and the integrated signal is compared to the preset second reference level signal L2 in the comparator 68. As the integrated signal of the signals Sx, Sy corresponding to the weft yarn detection signal exceeds the second reference level signal L2 as shown at S6 in FIG. 19(*g*), the weft yarn arrival signal S7 is outputted from the comparator 68. Thus the weaving operation is continued without stopping the loom.

When a failure in the weft insertion has occurred, that is, when the weft yarn Y has failed to reach the location of the weft sensor 18, the signal S5 does not reach the first reference level signal L1, so that no output signal of the preset amplitude is supplied from the comparator 66. Thus, as a matter of course, the integrated signal does not reach the second reference level signal L2 and no weft yarn arrival signal S7 is supplied, so that the loom operation is brought to a stop.

Figure 20:
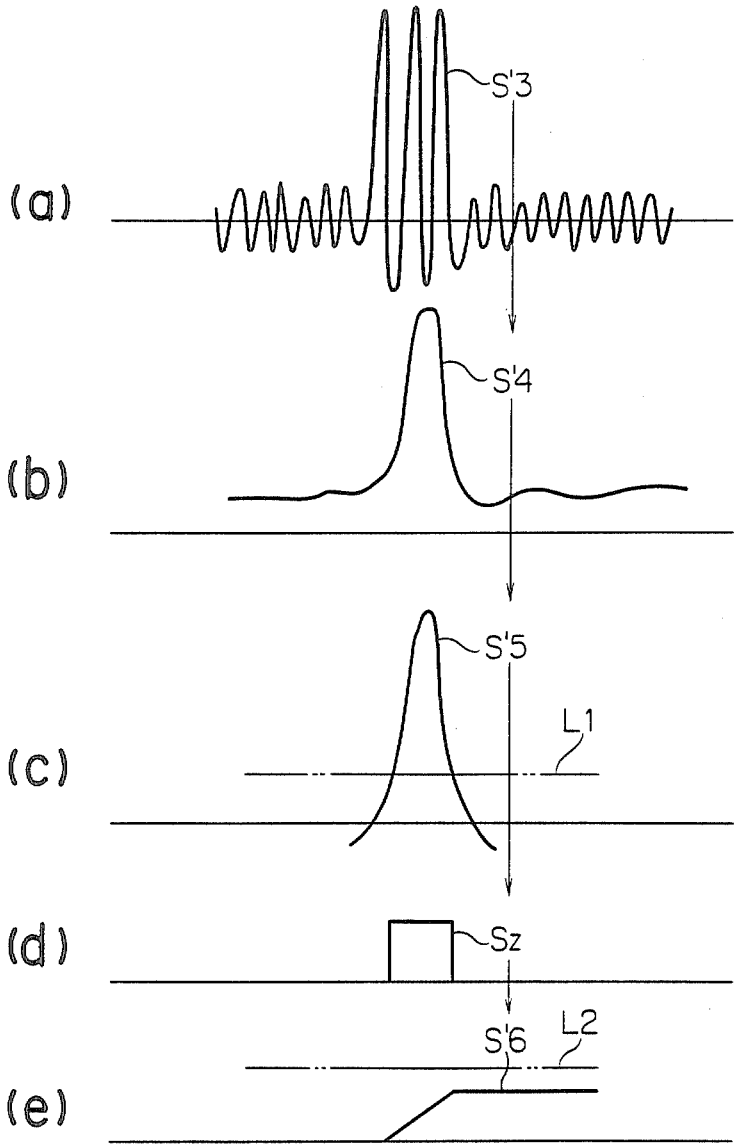
FIGS. 20(*a*) to (*e*) are diagrams showing the various process stages of the weft yarn detection signals in the method of FIG. 18.

In case of a failure in weft insertion, i.e. when the weft yarn Y does not reach the location of the weft yarn sensor 18, flying cotton may travel past the weft yarn sensor at the time of the weft detection. This causes a large change in the volume of the reflected light so that the output signal S'3 (FIG. 20) supplied from the filter circuit 63 as shown in FIG. 20(*a*) causes the signal S'4 obtained after the detection of the signal S'3 to be also increased. However, the signal S'4 is compared prior to integration to the first reference level signal L1 at the comparator 66, so that the number of signals outputted from the comparator 66 is less than in the case of the weft detection, as shown at Sz in FIG. 20(*d*). Thus, as shown in FIG. 20(*e*), the integrated signal S'6 of the signal Sz does not reach the second reference level signal L2 and no weft yarn arrival signal S7 is outputted so that the loom operation ceases. In this manner, the signal corresponding to a large change in the light volume is compared to the first reference level signal L1 in the comparator 66 so that the amplitude of the light volume change signal is replaced by the signal at the same level as the weft detection signal. Hence, the integrated value of the output signal from the comparator 66 is markedly less than the integrated value corresponding to the weft yarn detection signal and less than the second reference level signal L2. In other words, the second reference level signal L2 which forms the basis for detecting the presence or absence of the weft yarn can be easily set between the integrated value of the signal corresponding to the change in the weft yarn detecting light volume and the integrated value of the signal corresponding to the large change in the cotton detecting light volume, thus resulting in improved accuracy in weft yarn detection.

Although various specific embodiments have been described above, it will be readily understood by those skilled in the art that various rearrangements of parts and modifications of parts may be accomplished without departing from the spirit and scope of the invention as defined, in the appended claims. For example, a weft yarn sensor according to the invention may be set out of the area of the cloth width and plural weft yarn sensors may be provided within the cloth width and so coordinated that the detection by one of the sensors of the weft filling error is checked or modified by other sensors. Alternatively, weft yarn detection signals from the sensor may be taken by, for example, an oscilloscope for measuring the speed of the weft yarn or the time the yarn end reaches a preset position for correctly designing the jet timing from the auxiliary nozzle as a function of the changes in the cloth width and/or the kind or the number of denier of the weft yarn. In addition, by designing the location of the weft yarn sensor to be closer to the weft-filling main nozzle, detection of the failure in the weft filling can be attained at an earlier time. The photo-sensor enclosing section can be formed of an insulating material such as ceramics, the lead wire guide groove may be formed in the attachment section, or the lead may be encapsulated in the guide groove. An absolute value circuit may be provided at the front side of the weft yarn detection circuit shown in FIG. 18, or a filter and/or amplifier may be interposed at the desired location in the circuit.

What is claimed is:

1. A light reflection type weft detection apparatus in a jet loom in which the weft yarn is inserted and carried by a jet fluid substantially centrally within a weft guide channel provided along a reed mounted on a slay, and wherein the weft guide channel moves laterally within the wrap shed formed by warp yarns responsive to reciprocal movement of said slay, said detection apparatus comprising a light emitting element having an optical axis extending in direction into said weft yarn guide channel to strike a weft yarn while being so carried substantially centrally therein, a light receiving element having an optical axis extending in substantially said direction into said weft yarn guide passage and adapted for receiving the light projected from said light emitting element and reflected by said weft yarn while being so carried substantially centrally within said guide channel, and narrow width supporting means for supporting said light emitting and receiving elements, said supporting means being mounted on and positioned along the length of said slay to move said light emitting and receiving elements between said warp yarns into and out from said warp shed responsive to said reciprocal movement of said slay, whereby the presence of said weft yarn is detected by said light emitting and receiving elements while within said warp shed and while said weft yarn is being so carried substantially centrally within said guide channel.

2. The apparatus according to claim 1, wherein said supporting means comprises a pair of narrow width supporting pieces spaced apart in side-by-side relation along and adjacent to said guide channel, one of said supporting pieces supporting said light emitting element and the other supporting piece supporting said light receiving element.

3. The apparatus according to claim 2, wherein said supporting pieces are attached to an attachment member adjustably mounted on said slay for displacement and positioning at a selected location along the length of said guide channel.

4. The apparatus according to claim 2, wherein each said supporting piece is in a bar form, one end portion of the bar adjacent to said slay being formed of a rigid material, and the opposite end of the bar being formed of an insulating material, said light emitting and receiving elements being attached to said opposite end portions of the respective of said bars.

5. The apparatus according to claim 4, wherein said rigid material is stainless steel and said insulating material is selected from the group of nylon, bakelite and Duracon.

6. The apparatus according to claim 3, wherein at least one of said supporting pieces is mounted on said attachment member for rotation about an axis parallel to the other of said supporting pieces for adjusting the directions relative to each other of the optical axes of said light emitting and receiving elements.

7. The apparatus according to claim 2, wherein said light emitting and light receiving elements are arranged adjacent to the lower area of the opening of said weft yarn guide channel and the optical axes of said sections pass through an imaginary circle inscribed within wall surfaces delimiting said weft yarn guide channel.

8. The apparatus according to claim 7, wherein said supporting pieces are adjustably attached to said attachment member for adjustment of the trajectory of said optical axes.

9. The apparatus according to claim 7, wherein said optical axes pass through substantially the center of said imaginary circle.

10. The apparatus according to claim 7, wherein said optical axes pass through substantially the third quadrant of said circle, as determined clockwise from the top of said weft yarn guide channel commencing towards said opening of the weft guide channel.

11. The apparatus according to claim 2, wherein the optical axes of said light emitting and receiving elements are arranged substantially parallel to each other and in direction projection into the weft yarn guide channel, and the distance between the respective incipient points of said optical axes is less than 5 mm while the distance between the incipient point of either optical axis and the point of intersection of the optical axis with wall surfaces of said guides defining the weft yarn guide channel is from substantially 8 to 13 mm.

12. A method for detecting the weft yarn within a weft guide channel in an operating fluid jet loom comprising the steps of emitting pulses of light from a location within the warp shed and along the width of the cloth being woven and directed on an optical axis extending into the weft yarn guide channel to strike a weft yarn while travelling substantially centrally therein and before reaching the end thereof, and detecting reflected pulse signals of said light from said weft yarn channel at a second location adjacent to said first location within said warp shed, counting the number of pulse signals within a predetermined range including said reflected warp yarn detection signals, assuming the occurrence of weft detection when the count number has reached a preset value, and stopping said loom operation when said count number fails to reach said preset value.

13. A method for detecting the weft yarn travelling within a weft yarn channel in an operating fluid jet loom comprising the steps of emitting pulses of modulated light from a location within the warp shed and along the width of the cloth being woven and directed on an optical axis extending into the weft yarn guide channel to strike a weft yarn while travelling therein and before reaching the end thereof, and detecting reflected pulse signals of said light from said weft yarn channel at a second location adjacent to said first location within said warp shed, detecting output signals reflected from said weft yarn channel, comparing the detected signals to a first reference level signal, outputting a preset signal when the detected signal is above a first reference level signal, integrating said preset signal, comparing the integrated value to a second reference level signal, assuming the occurrence of weft detection when the integrated value is higher than the second reference level signal, and stopping said loom operation when said integrated value fails to reach said second reference level signal.

* * * * *